US008662303B2

(12) United States Patent
Yoshida et al.

(10) Patent No.: US 8,662,303 B2
(45) Date of Patent: Mar. 4, 2014

(54) PACKAGING BOX

(75) Inventors: Takaaki Yoshida, Kanagawa (JP); Hiroshi Tsuyuki, Kanagawa (JP); Yasuhiro Minamidate, Kanagawa (JP); Hideki Yamamoto, Kanagawa (JP); Keigo Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 364 days.

(21) Appl. No.: 13/092,474

(22) Filed: Apr. 22, 2011

(65) Prior Publication Data

US 2012/0085678 A1 Apr. 12, 2012

(30) Foreign Application Priority Data

Oct. 8, 2010 (JP) ..... 2010-228553

(51) Int. Cl.
*B65D 81/02* (2006.01)
*B65D 73/00* (2006.01)
*B65D 71/08* (2006.01)

(52) U.S. Cl.
USPC ..... 206/521; 206/1.5; 206/588; 206/586

(58) Field of Classification Search
USPC ..... 206/521, 523, 524, 585–594, 1.5
See application file for complete search history.

(56) References Cited

U.S. PATENT DOCUMENTS

| | | | | |
|---|---|---|---|---|
| 4,865,200 | A * | 9/1989 | Sullivan et al. | 206/583 |
| 5,398,808 | A * | 3/1995 | Chen et al. | 206/591 |
| 6,666,334 | B2 * | 12/2003 | Fujii | 206/586 |
| 7,021,024 | B2 * | 4/2006 | Kari | 206/485 |
| 7,303,071 | B2 * | 12/2007 | Saito | 206/586 |
| 7,469,786 | B1 * | 12/2008 | Rowley et al. | 206/521 |
| 8,251,220 | B2 * | 8/2012 | Ting et al. | 206/587 |
| 2005/0173295 | A1 * | 8/2005 | Muraoka | 206/593 |

FOREIGN PATENT DOCUMENTS

| | | |
|---|---|---|
| JP | 2000-247369 A | 9/2000 |
| JP | 2007-176522 A | 7/2007 |

* cited by examiner

*Primary Examiner* — Mickey Yu
*Assistant Examiner* — Chun Cheung
(74) *Attorney, Agent, or Firm* — Sughrue Mion, PLLC

(57) ABSTRACT

A packaging box includes a box body having a bottom board, side boards, and bending flaps; and a cushioning material having a bottom surface section and side surface sections. A restrainer is formed at least one of the bending flaps, the restrainer having a portion that is separated from and opposes the bottom board when the portion of the restrainer is bent into an accommodation space of the box body. A restrain portion is formed at the side surface section of the cushioning material opposing the restrainer formed at the at least one of the bending flaps, the restrain portion having a portion that is positioned at a side of the bottom board so as to abut upon the portion of the restrainer and that opposes the portion of the restrainer when the cushioning material is fitted in the accommodation space of the box body.

8 Claims, 38 Drawing Sheets

PACKAGING BOX

CROSS-REFERENCE TO RELATED APPLICATIONS

This application is based on and claims priority under 35 USC 119 from Japanese Patent Application No. 2010-228553 filed Oct. 8, 2010.

BACKGROUND (i) Technical Field

The present invention relates to a packaging box.

SUMMARY

According to an aspect of the invention (A1), there is provided a packaging box including a box body having a bottom board, side boards, and bending flaps, the bottom board having a polygonal shape, the side boards standing from respective sides of the bottom board, the bending flaps bending at upper ends of the respective side boards, a space surrounded by the bottom board and the side boards being used as an accommodation space that accommodates a packaging object; and a cushioning material having a bottom surface section and cushioning-material side surface sections, the bottom surface section having a polygonal shape which is substantially the same polygonal shape of the bottom board of the box body, the cushioning-material side surface sections standing from respective sides of the bottom surface section, the cushioning material being fitted in the accommodation space of the box body and existing between the box body and the packaging object accommodated in the accommodation space. The bottom surface section of the cushioning material defines an air hole. A restrainer is formed at least one of the bending flaps of the box body, the restrainer having a portion that is separated from and opposes the bottom board of the box body when the portion of the restrainer is bent into the accommodation space of the box body. A restrain portion is formed at the cushioning material side surface section of the cushioning material opposing the restrainer formed at the at least one of the bending flaps, the restrain portion having a portion that is positioned at a side of the bottom board of the box body so as to abut upon the portion of the restrainer and that opposes the portion of the restrainer when the cushioning material is fitted in the accommodation space of the box body.

BRIEF DESCRIPTION OF THE DRAWINGS

Exemplary embodiments of the present invention will be described in detail based on the following figures, wherein.

DETAILED DESCRIPTION

Modes for carrying out the present invention (hereunder simply referred to as "exemplary embodiments") will hereunder be described with reference to the attached drawings.

First Exemplary Embodiment

Figure 1:
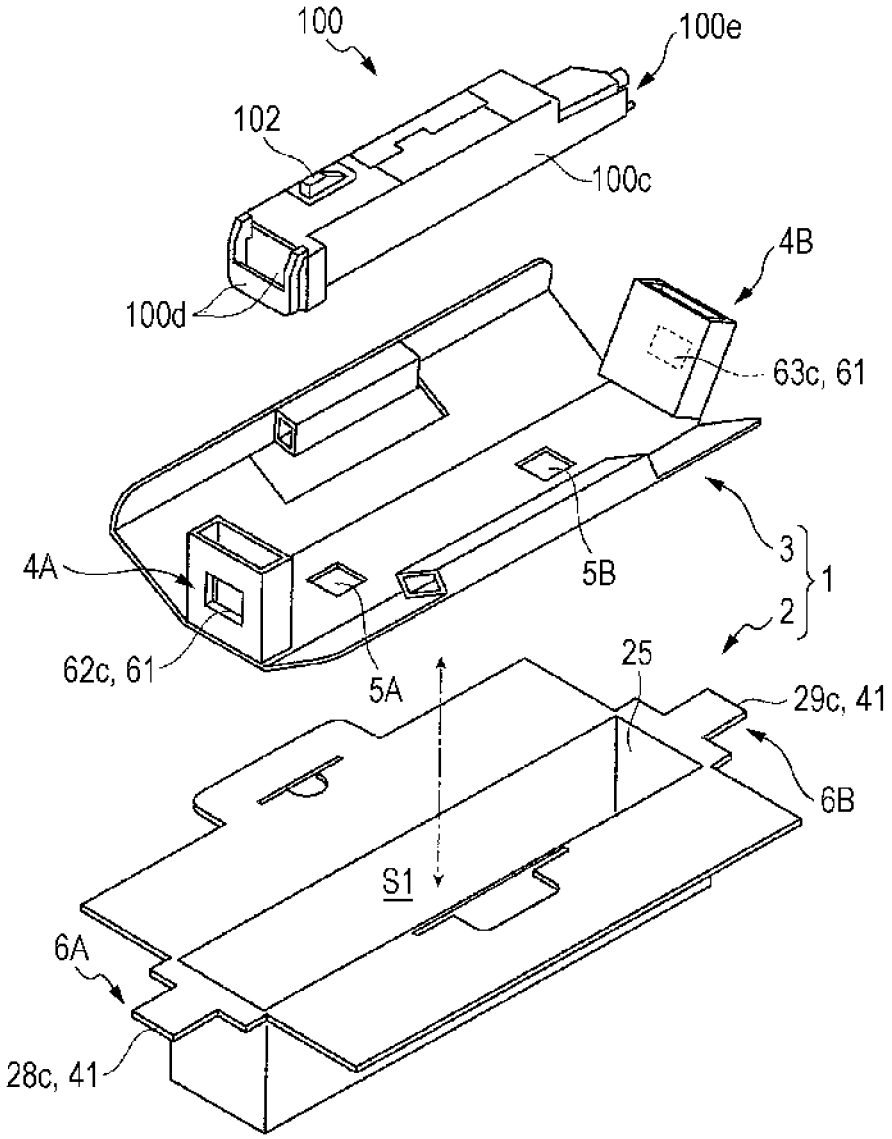
FIG. 1 is an exploded perspective view of a packaging box, etc., according to a first exemplary embodiment of the present invention.

FIGS. 1 to 6 show a packaging box 1 according to a first exemplary embodiment. FIG. 1 shows structural portions of the packaging box 1 and a packaging object 100. FIGS. 2 to 6 show states of use of the packaging box 1 (that is, the states of principal packaging steps).

Figure 2:
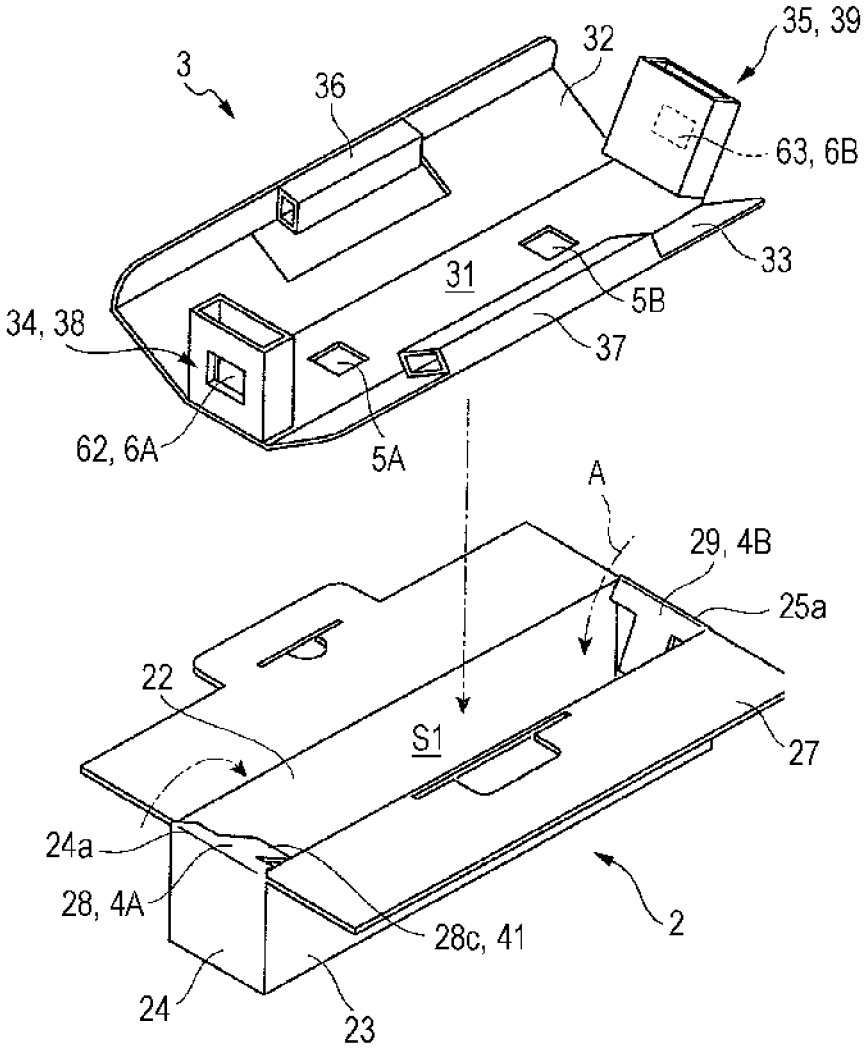
FIG. 2 is a perspective view showing a state of a packaging step using the packaging box shown in FIG. 1, that is, the step in which flaps where restrainers of a box body are formed are bent.
Figure 3:
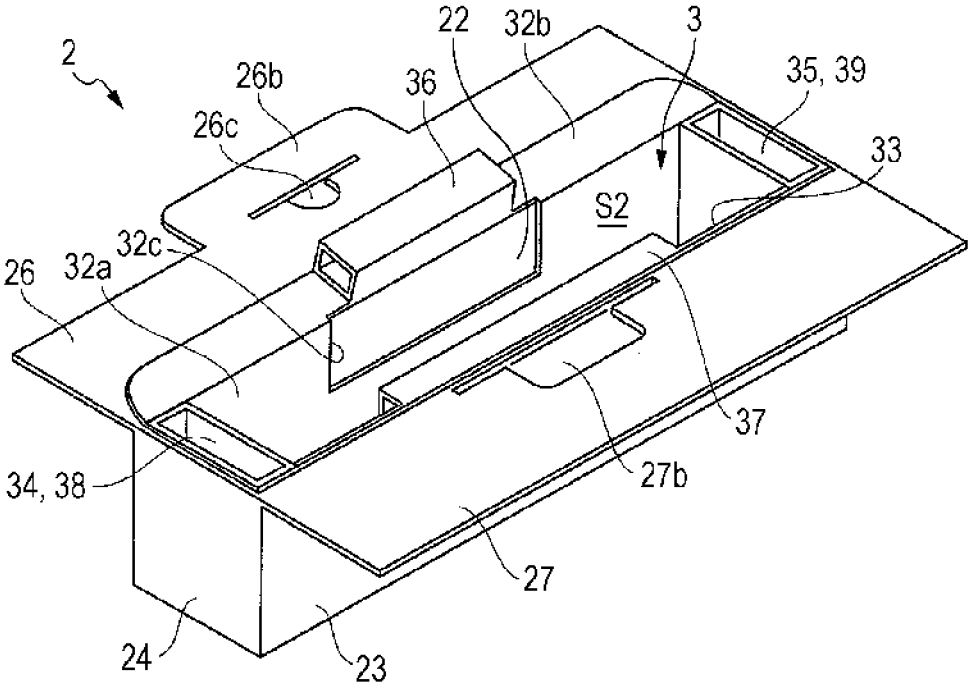
FIG. 3 is a perspective view showing a state of another packaging step using the packaging box shown in FIG. 1, that is, the step of fitting a cushioning material into an accommodation space of the box body.

As shown, for example, from FIGS. 1 to 3, the packaging box 1 according the first exemplary embodiment includes a box body 2 and a cushioning material 3. The box body 2 has an accommodation space S1 that accommodates the packaging object 100. The cushioning material 3 is fitted into the accommodation space S1 of the box body 2, and exists between the box body 2 and the packaging object 100 that is accommodated in the accommodation space S. As shown, for example, from FIGS. 4 to 6, the packaging object 100 is accommodated in an accommodation space S2 surrounded by the cushioning material 3 fitted in the accommodation space S1 of the box body 2. The cushioning material 3 is capable of absorbing shock, and protects the packaging object 100 from, for example, shock that is applied to the box body 2 from the outside.

First, as shown, for example, from FIGS. 1 to 7, the box body 2 has a box structure including a rectangular bottom board 21, four rectangular side boards 22 to 25 that stand from respective sides 21*a* to 21*d* of the bottom board 21, and four flaps (bending boards) 26 to 29 that are bent from upper ends 22*a* to 25*a* of the respective side boards 22 to 25. With the four side boards 22 to 25 of the box body 2 that are adjacent to each other being previously connected to each other while the four side boards 22 to 25 (formed continuously from the respective sides of the bottom board 21) stand substantially vertically, a quadrangular prismatic space surrounded by the four side boards 22 to 25 and the bottom board 21 is used as the accommodation space S1 that accommodates the packaging object 100. The box body 2 is formed as follows. That is, one corrugated cardboard, which is cut on the basis of a shape of a development diagram, is used; predetermined portions of the cut corrugated cardboard are bent; and the predetermined portions are fixed to each other with a staple, an adhesive, etc., to assemble the predetermined portions to a predetermined box-shaped structure.

The first flap 26, provided at the first side board 22 and standing from the long side 21*a* of the bottom board 21, constitutes an outer cover that covers an open portion of the box body 2 last during packaging. The first flap 26 has a shape defined by a rectangular body portion 26*a* and a rectangular inserting portion 26*b*. The shape and dimensions of the body portion 26*a* are substantially the same as those of the bottom board 21. The inserting portion 26*b* projects from substantially a center portion of a free end of the body portion 26*a*. Reference numeral 26*c* in the figures denotes a catch cutaway portion. The catch cutaway portion 26*c* is cut into a shape that makes it easier to bend the inserting portion 26*b* at the free end of the body portion 26*a*, and that is suitable for use as a catch into which a finger of a person's hand is inserted when the first flap 26 (serving as an outer cover) is opened.

The second flap 27, provided at the second side board 23 and standing from the other long side 21*b* of the bottom board 21, constitutes an inner cover that, together with the outer cover, covers the open portion of the box body 2 last during the packaging. The second flap 27 has a shape defined by a rectangular body portion 27*a* and an insertion cutaway portion 27*b*. The shape and dimensions of the body portion 27*a* are substantially the same as those of the bottom board 21. The insertion cutaway portion 27*b* is cut into a shape that makes it easier to bend the body portion 27*a* at the upper end 23*a* of the second side board 23, and that is suitable for use as an insertion hole into which the inserting portion 26*b* of the first flap 26 serving as an outer cover is inserted.

Further, as shown in, for example, FIGS. 2, 7, 8B, and 12, the third flap 28 at the third side board 24 standing from the short side 21*c* of the bottom board 21 and the fourth flap 29 at the fourth side board 25 standing from the short side 21*d* of the bottom board 21 have respective restrainers 4A and 4B having portions 41 that are separated from and oppose the bottom board 21 of the box body 2 when the flaps 28 and 29 are bent in the accommodation space S1 of the box body 2.

Figure 7:
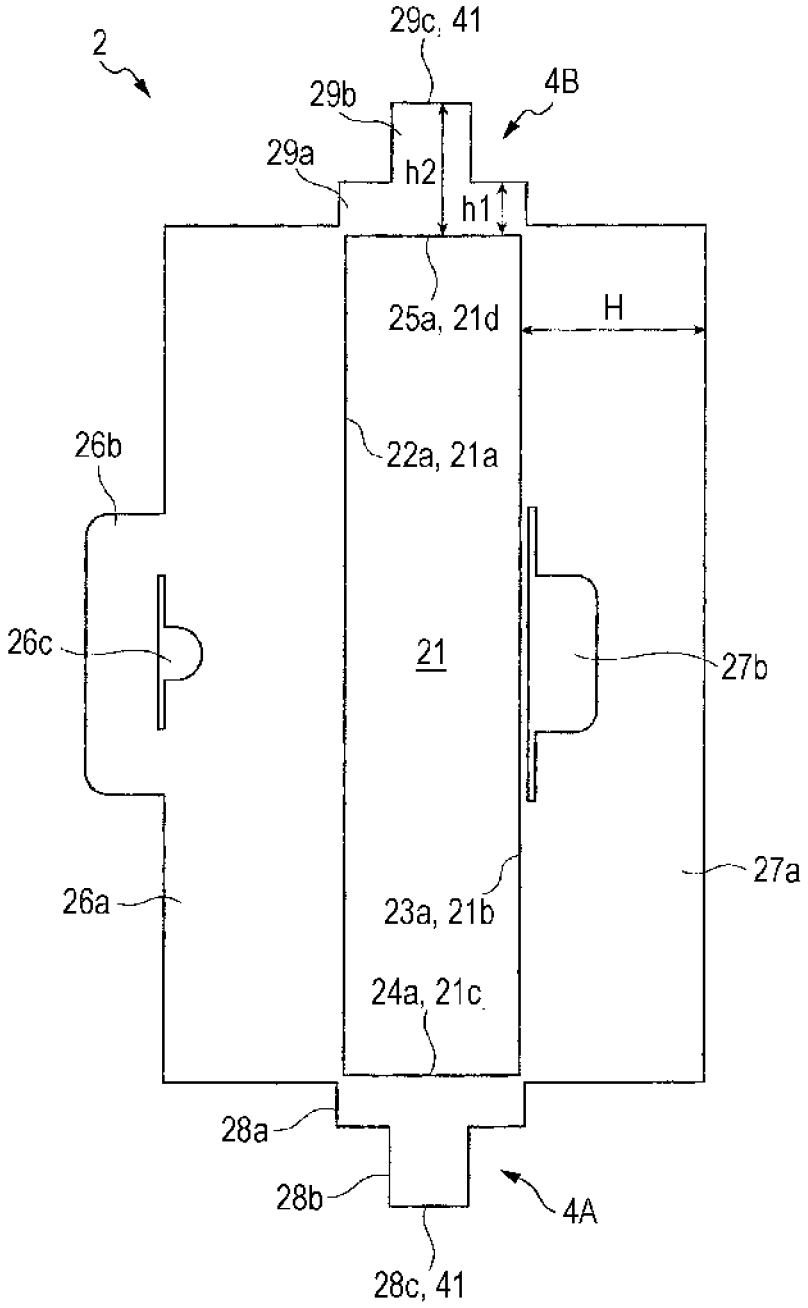
FIG. 7 is a plan view of the box body constituting the packaging box shown in FIG. 1.

As shown in, for example, FIG. 7, the third flap 28 having the restrainer 4A has a shape that is defined by a rectangular body portion 28*a* and a rectangular projection 28*b*; and the fourth flap 29 having the restrainer 4B has a shape that is defined by a rectangular body portion 29*a* and a rectangular projection 29*b*. The body portions 28*a* and 29*a* have widths that are substantially the same as the widths of the short sides of the bottom board 21 and have heights h1 that are lower than heights H of the side boards 24 and 25 (for example, approximately ¼ of the heights H of the side boards 24 and 25). The projections 28*b* and 29*b* project from substantially center portions of free ends of the respective body portions 28*a* and 29*a*. Heights h2 to the projections 28*b* and 29*b* from an upper end 24*a* of the third side board 24 and the upper end 25*a* of the fourth side board 25 are set lower than the heights H of the respective side boards 24 and 25 (for example, approximately ½ to ¾ of the heights H of the side boards 24 and 25). The projections 28*b* and 29*b* have widths that are approximately half the lengths of the short sides of the bottom board 21 (the widths of the side boards 24 and 25).

The restrainers 4A and 4B are formed so that end portions 28*c* and 29*c*, serving as a free end of the projection 28*b* of the third flap 28 and a free end of the projection 29*b* of the fourth flap 29, are used as portions 41 that are separated from and oppose the bottom board 21 of the box body 2 when they are bent in the accommodation space S1. The restrainers 4A and 4B are such that, when the body portion 28*a* and the projection 28*b* of the third flap 28 and the body portion 29*a* and the projection 29*b* of the fourth flap 29 are bent into the accommodation space S1, the flaps 28 and 29 are separated from the respective side boards 24 and 25 due to a restoring reaction force without staying in an approached or contact state with respect to the third side board 24 and the fourth side board 25 that oppose the flaps 28 and 29 (see, for example, FIGS. 12A and 12B). This characteristic is thought to be obtained due to the following reason. That is, since the corrugated cardboard is elastically deformed because the bending portions at the upper ends 24*a* and 25*a* of the side boards are slightly elastic when the flanges 28 and 29 are bent, a reaction force occurs with respect to the elastic deformation, so that the flaps 28 and 29 are displaced in a restoring direction (that is, a direction opposite to a bending direction) by the reaction force.

Figure 9:
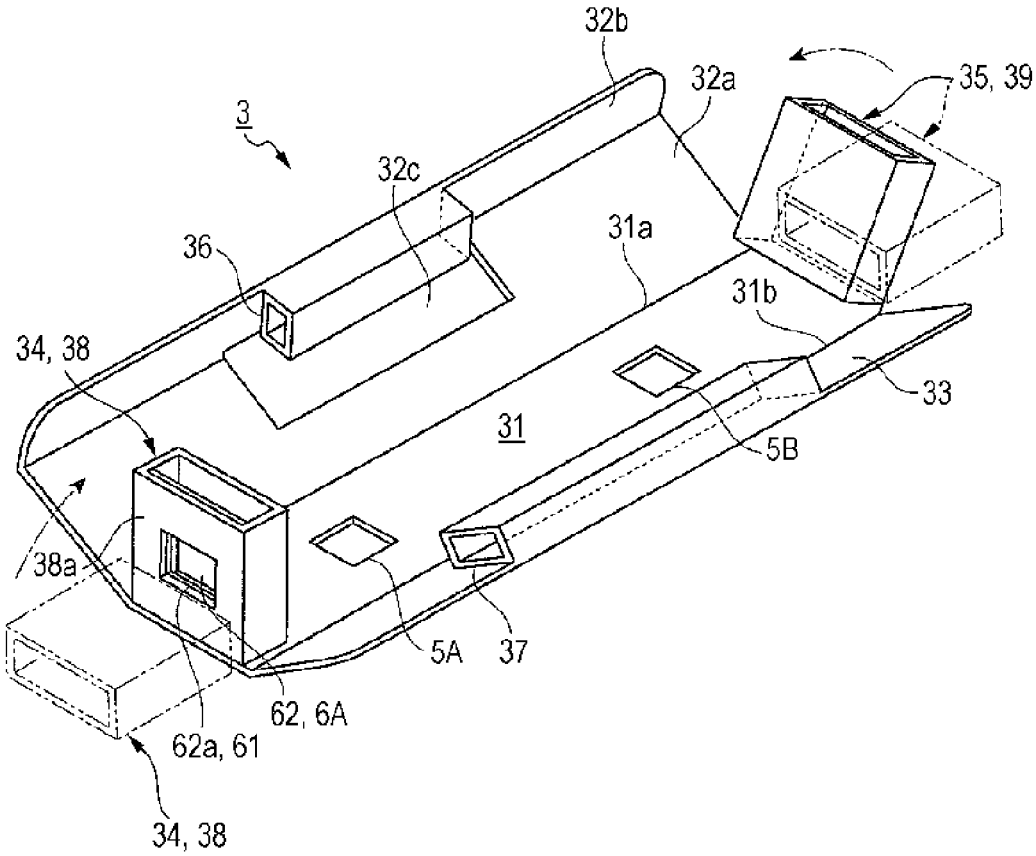
FIG. 9 is a perspective view of the cushioning material constituting the packaging box shown in FIG. 1.

As shown, for example, from FIGS. 1 to 7 and in FIG. 9, the cushioning material 3 includes a bottom surface section 31 and four cushioning-material side surface sections 32 to 35. Like the bottom board 21 of the box body 2, the bottom surface section 31 has a rectangular shape. The side surface sections 32 to 35 stand from respective sides of the bottom surface section 31. The cushioning material 3 is a cushioning-material structural member that is used while being fitted in the accommodation space S1 of the box body 2 at least when packaging is performed, and existing between the box body 2 and the packaging object 100 that is accommodated in the accommodation space S1. That is, one corrugated cardboard, which is cut on the basis of a shape of a development diagram, is used; predetermined portions of the cut corrugated cardboard are bent; and the predetermined portions are fixed to each other with a staple, an adhesive, etc., to assemble the cushioning material 3. Therefore, the bottom surface section 31 and the cushioning-material side surface sections 32 to 35 are formed into the shapes defined by and as structural portions using the board portions of the corrugated cardboard. The cushioning-material side surface sections 32 to 35 have cushioning material structures that are formed on the basis of conditions such as the positions, dimensions, and shapes in accordance with the external shape of the packaging object 100 to be packaged.

Since it is necessary to fit the cushioning material 3 into the accommodation space S1 of the box body 2, the planar dimensions of the bottom surface section 31 are set smaller than the rectangular dimensions of the bottom board 21 of the box body 2 (long side: length L; short side: width W) by, for example, approximately a few mm to several tens of mm. The bottom surface section 31 is formed as a planar bottom board formed using one corrugated cardboard. The cushioning-material side surface sections 32 to 35 are formed so as to have portions that oppose at least the inner sides of the four side boards 22 to 25 of the box body 2 when the cushioning material 3 is fitted in the accommodation space S1 of the box body 2. In addition, the cushioning-material side surface sections 32 to 35 are formed as side boards having cushioning-material structural portions selected in accordance with the external shape of the packaging object 100 to be packaged.

Of the side surface sections 32 to 35, the first side surface section 32 standing from a long side 31*a* has a shape that is defined by a rectangular side board portion 32*a*, a long-and-narrow bending portion 32*b*, and a first cushioning-material structural portion 36. The side board portion 32*a* substantially opposes the inner side of the first side board 22. The bending portion 32*b* is bent onto the upper surface of the packaging object 100 at the upper end of the side board portion 32*a*. The first cushioning-material structural portion 36 is bendably connected to an end of the bending portion 32*b*. Reference numeral 32*c* in FIG. 9, etc., denotes a cutaway portion. The first cushioning-material structural portion 36 is a hollow cushioning-material structural portion formed so as to have an overall prismatic shape formed by inwardly bending a planar rectangular extending portion along bending lines that are substantially parallel to the long side 31*a* of the bottom board 31 (that is, mountain-bending) and by singly winding the extending portion. The extending portion is formed so as to project from substantially a center portion of the bending portion 32*b* by a width of approximately ⅓ of the length L of the long side. The first cushioning-material structural portion 36 is capable of existing at the inner side of the bending portion 32*b* by bending it at the end of the bending portion 32*b*.

The second side surface section 33 standing from the other long side 31*b* of the bottom board 31 has a shape that is defined by a rectangular side board portion 33*a* and a second cushioning-material structural portion 37. The side board portion 33*a* substantially opposes the inner side of the second side board 23 of the box body 2. The second cushioning-material structural portion 37 is bendably connected to an upper end of the side board portion 33*a*. The second cushioning-material structural portion 37 is a hollow cushioning-material structural portion having an overall flat prismatic shape formed by inwardly bending a planar rectangular extending portion along bending lines that are substantially parallel to the long side 31*b* of the bottom board 31 (that is, mountain-bending) and by singly winding the extending portion. The extending portion is formed so as to project from substantially a center portion of the side board portion 33*a* by a width of approximately ½ of the length L of the long side. The second cushioning-material structural portion 37 is capable of existing at the inner side of a bending portion 32*b* by bending it at the upper end of the side board portion 33*a*.

As shown, for example, from FIGS. 2 to 6 and from FIGS. 9 to 12B, a third side surface section 34 and a fourth side surface section 35 standing from respective short sides 31*c* and 31*d* of the bottom board 31 are formed as a third cushioning-material structural portion 38 and a fourth cushioning-material structural portion 39, respectively, which are bendably connected from the respective short sides 31*c* and 31*d*. As shown in, for example, FIGS. 9 and 11, the third cushioning-material structural portion 38 and the fourth cushioning-material structural portion 39 are hollow cushioning-material structural portions having overall prismatic shapes (that is, having overall rectangular shapes in cross section) formed by inwardly bending planar rectangular extending portions along bending lines that are substantially parallel to the long side of the bottom board (that is, mountain-bending) and by doubly winding only portions close to the respective short sides of the bottom board 31. The extending portions are formed so as to project from the respective short sides 31*c* and 31*d* of the bottom board 31. As shown in, for example, FIG. 9, the third cushioning-material structural portion 38 and the fourth cushioning-material structural portion 39 are capable of existing on the bottom board 31 by bending them in the directions in which they stand at the respective short sides 31*c* and 31*d* of the bottom board 31 (that is, in the directions of dotted arrows in FIG. 9).

Figure 10:
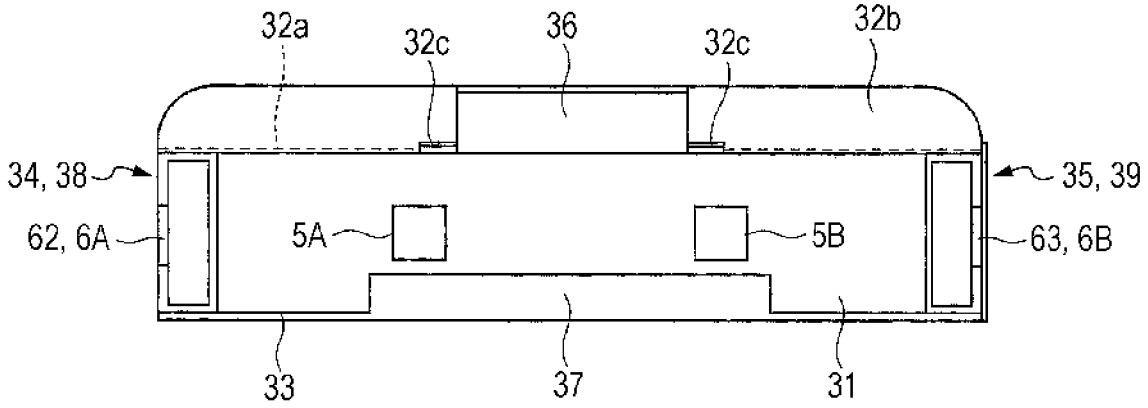
FIG. 10 is a plan view showing a state in which the cushioning material shown in FIG. 9 is fitted into the box body.
Figure 11:
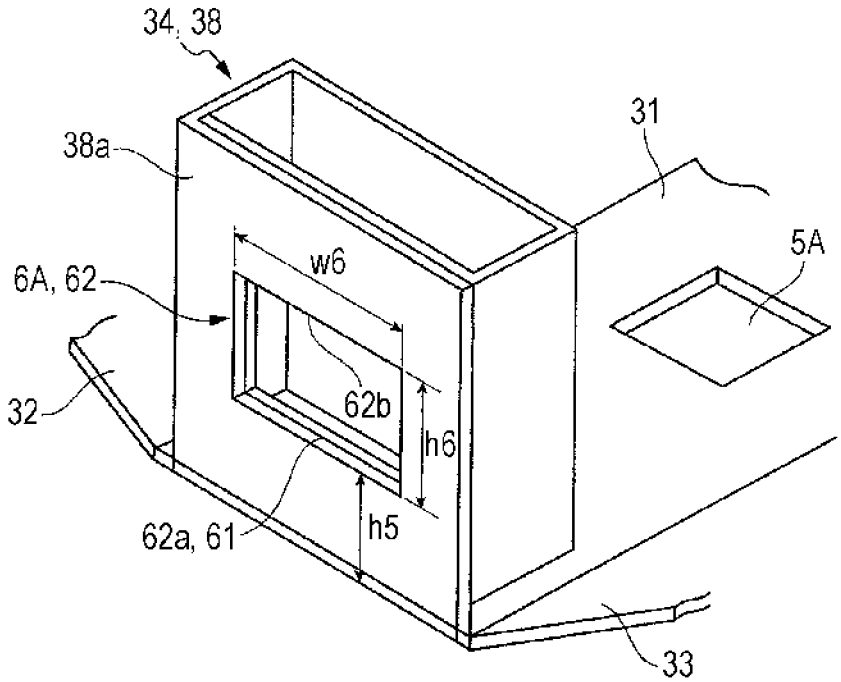
FIG. 11 is a perspective view showing a principal portion (such as an air hole and a cushioning-material side surface section where a restrain portion is formed) of the cushioning material shown in FIG. 9.

As shown, for example, from FIGS. 9 to 11, the cushioning material 3 defines two rectangular air holes 5A and 5B formed in the bottom board 31.

When the cushioning material 3 is fitted into the accommodation space S1 of the box body 2, the cushioning material 3 is required to enter the accommodation space S1 while pushing out air existing in the accommodation space S1 to the outside. Therefore, the air holes 5A and 5B are provided as holes (openings) for allowing the air existing in the accommodation space S1 to pass therethrough so as to be removed to the outside. The air holes 5A and 5B allow the cushioning material 3 to be easily fitted into the accommodation space S1 of the box body 2 as described below. The opening shapes, the number, and the position of formation of the air holes 5A and 5B are not particularly limited as long as, for example, they do not hinder packaging and do not considerably reduce the strength of the cushioning material 3.

In the cushioning material 3, the third side surface section 34 and the fourth side surface section 35 oppose the restrainers 4A and 4B, formed at the third flap 28 and the fourth flap 29 of the box body 2, when the cushioning material 3 is fitted in the accommodation space S1 of the box body 2. Therefore, restrain portions 6A and 6B having portions 61 are formed at the respective surfaces 34 and 35. The portions 61 are positioned at the side of the bottom board 21 of the box body 2 so as to abut upon the portions 41 of the respective restrainers 4A and 4B, and oppose them when the cushioning material 3 is fitted in the accommodation space S1 of the box body 2.

The restrain portions 6A and 6B define rectangular hollow structural portions (through holes) 62 at outer surfaces 38*a* and 39*a* of the double structure of the respective cushioning-material structural portions 38 and 39 at the third side surface section 34 and the fourth side surface section 35. Lower sides 62*a* and 63*a* of the rectangular through holes are used as the portions 61 that oppose the respective restrainers 4A and 4B.

The lower sides 62*a* and 63*a* serving as the portions 61 of the respective through holes are set so that heights h5 from the bottom surface section 31 are substantially equal to differences obtained by subtracting the heights h2 of the projections 28*b* and 29*b* of the respective flaps 28 and 29 from the heights H of the third side board 24 and the fourth side board 25 of the box body 2 (that is, H-h2). Opening widths w6 of the respective through holes 62 and 63 (that is, the widths of portions parallel to the short sides of the bottom surface section 31) are set to values that are wider than the widths of the projections 28*b* and 29*b* of the respective flaps 28 and 29. Therefore, end portions of the respective projections 28*b* and 29*b* are capable of entering the respective through holes 62 and 63 (hollow portions).

Opening heights h6 of the respective through holes 62 and 63 (that is, distances from the lower sides 62*a* and 63*a* to respective upper sides 62*b* and 63*b*) are set principally from the following viewpoints. That is, the end portions 28*c* and 29*c* serving as the portions 41 of the projections 28*b* and 29*b* oppose the respective lower sides 62*a* and 63*a* (see FIG. 13). Therefore, even if, in this state, the upper sides 62*b* and 63*b* of the respective through holes 62 and 63 contact portions of the respective projections 28*b* and 29*b* that are bent, the portions 41 and 61 are not prevented from abutting upon and opposing each other, so that it is possible to maintain a state after the portions 41 and 61 oppose each other.

Next, the states of the principal packaging steps using the packaging box 1 will be described.

Figure 4:
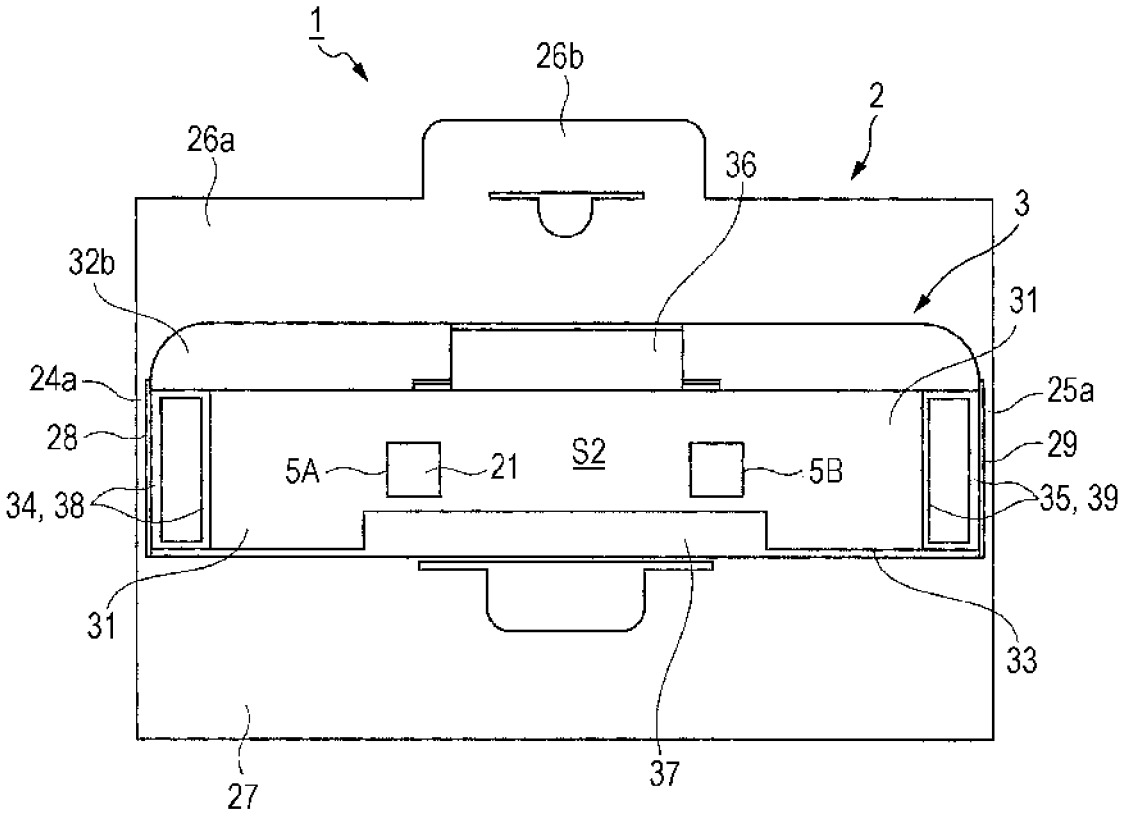
FIG. 4 is a top plan view of the packaging box shown in FIG. 3.

First, as shown, for example, from FIGS. 2 to 4, in the packaging box 1, the cushioning material 3 is fitted into the accommodation space S1 of the box body 2.

Figure 8A:
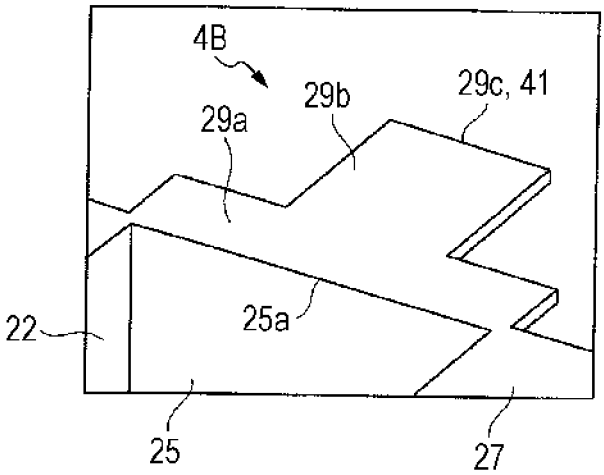
FIGS. 8A and 8B show a principal portion of the packaging box shown in FIG. 7 (that is, a flap that is formed as a restrainer), with FIG. 8A being a perspective view of the structure of the principal portion, and FIG. 8B being a perspective view of a state in which the principal portion is bent.
Figure 8B:
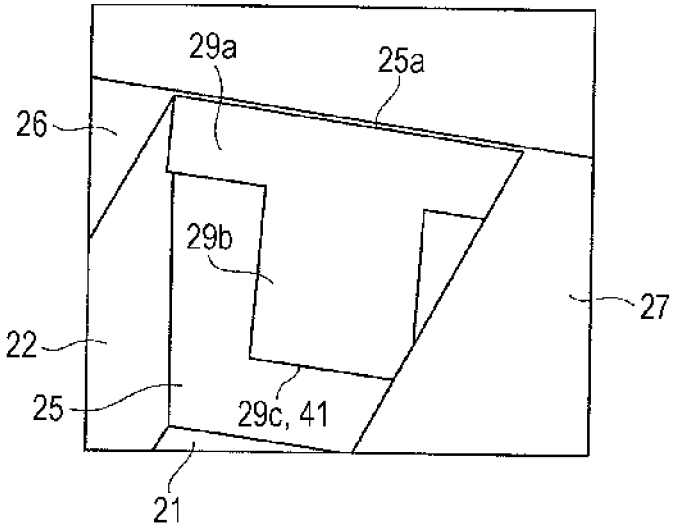

More specifically, as shown in, for example, FIGS. 2 and 8B, first, in the box body 2, the flaps 28 and 29 having the restrainers 4A and 4B are bent in the directions of dotted arrows A along the upper ends 24*a* and 25*a* of the respective side boards so that the flaps 28 and 29 exist in the accommodation space S1. The end portions 28*c* and 29*c* (that is, the portions 41 of the restrainers 4A and 4B) of the projections 28*b* and 29*b* of the respective flaps 28 and 29 are made to oppose the bottom board 21 (see FIGS. 8B and 12A). The end portions 28*c* and 29*c* at this time are separated from and obliquely oppose the bottom board 21.

Figure 12A:
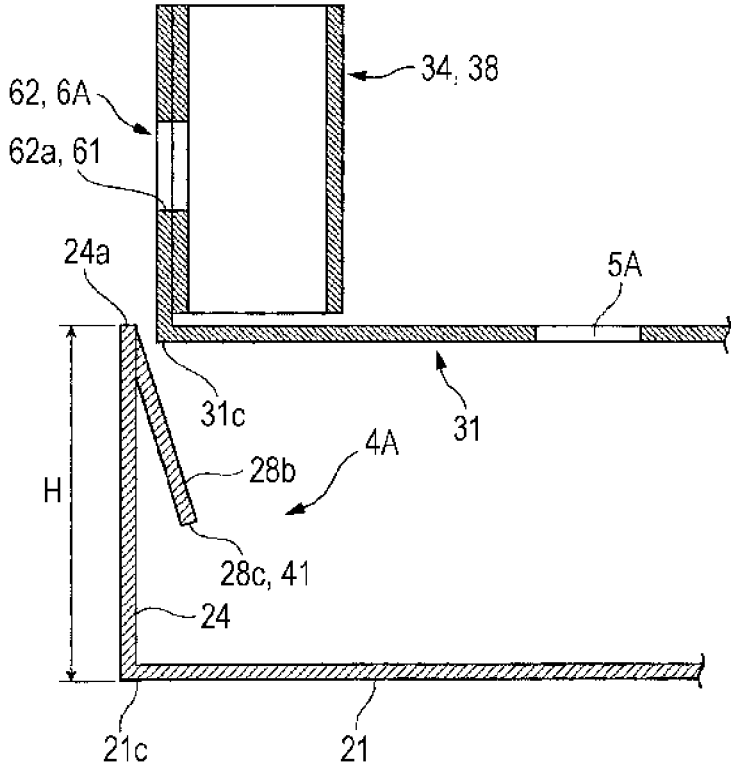
FIGS. 12A and 12B each show an operational step when the cushioning material shown in FIG. 9 is fitted into the accommodation space of the box body shown in FIG. 7, with FIG. 12A being a sectional view illustrating a state just before the cushioning material is fitted into the accommodation space, and FIG. 12B being a sectional view illustrating a state in which the cushioning material is being fitted into the accommodation space.

Next, as shown, for example, from FIGS. 2 to 4 and in FIG. 12A, the cushioning material 3 is fitted into the accommodation space S1 of the box body 2 whose flaps 28 and 29 are bent.

At this time, the shape of the bottom surface section 31 of the cushioning material 3 is the same as the shape of the bottom board 21 of the box body 2. In addition, the dimensions of the long sides and the short sides of the bottom surface section 31 are slightly smaller than those of the bottom board 21. Therefore, in fitting the cushioning material 3, as the bottom surface section 31 of the cushioning material 3 is inserted into the accommodation space S1 of the box body 2, the cushioning-material side surface sections 32 to 35 of the cushioning material 3 come into contact with and pass along the upper ends 22*a* to 25*a* of the respective opposing side boards 22 to 25 and the inner sides of the respective opposing side boards 22 to 25 of the box body 2. When the cushioning-material side surface sections 32 to 35 of the cushioning material 3 are passing along the upper ends 22*a* to 25*a* and the inner sides, the cushioning-material side surface sections 32 to 35 of the cushioning material 3 are bent in a substantially vertical standing state with respect to the bottom surface section 31, and are substantially in contact with the inner sides of the side boards 22 to 25 of the box body 2 opposing thereto (see FIGS. 3, 4, etc.). Strictly speaking, the cushioning-material side surface sections 34 and 35 do not contact the inner sides of the side boards 24 and 25 opposing thereto, and contact portions of the flaps 28 and 29 (see FIG. 12B and FIG. 13).

Figure 12B:
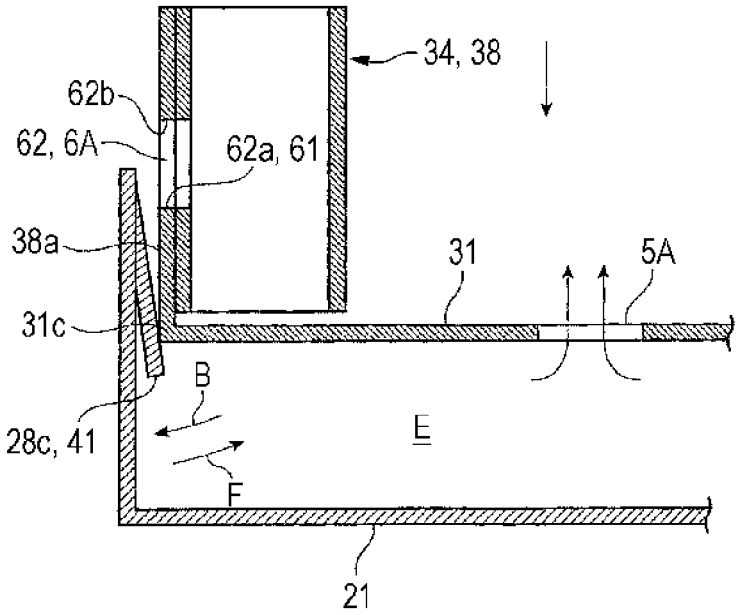

As a result, the cushioning material 3 enters the accommodation space S1 of the box body 2 so as to seal the accommodation space S1. As shown in FIG. 12B, air existing in a space E between the bottom surface section 31 of the cushioning material 3 and the bottom board 21 of the box body 2 is incapable of escaping and becomes compressed. Therefore, the fitting of the cushioning material 3 into the accommodation space S1 of the box body 2 tends to be subjected to the resistance of the air in the space E.

However, in the cushioning material 3, as shown by the arrows shown in FIG. 12B, it is possible to discharge the air in the space E to the outside through the air holes 5A and 5B formed in the bottom surface section 31. Therefore, the fitting of the cushioning material 3 into the accommodation space S1 of the box body 2 is easily performed without being subjected to the resistance of the air in the space E.

In the process of fitting the cushioning material 3 into the accommodation space S1 of the box body 2, as shown in FIG. 12B, the lower portions of the cushioning-material side surfaces 34 and 35 of the cushioning material 3 (that is, the short sides 31*c* and 31*d* of the bottom surface section 31 and the lower outer sides of the side surface sections) contact and push the flaps 28 and 29 of the box body 2 that are obliquely bent in the accommodation space S1. By this, the flaps 28 and 29 are further bent so as to be displaced in the direction B in which the flaps 28 and 29 approach or contact the side boards 24 and 25 of the box body 2. When the flaps 28 and 29 are further bent in this way, the corrugated cardboard is elastically bent at the upper ends 24*a* and 25*a* of the respective side boards 24 and 25. Therefore, a reaction force F that tries to restore the flaps 28 and 29 to a state (position) prior to the bending thereof is generated (see FIG. 12B).

Thereafter, when the cushioning material 3 is fitted into the accommodation space S1 of the box body 2 until the bottom surface section 31 of the cushioning material 3 contacts the bottom board 21 of the box body 2, the following occurs. That is, when the end portions 28*c* and 29*c* oppose the through holes 62 and 63 formed in the outer surfaces 38*a* and 39*a* of the respective cushioning-material structural portions 38 and 39 of the cushioning-material side surface sections 34 and 35, the end portions 28*c* and 29*c* of the projections 28*b* and 29*b* of the respective flaps 28 and 29 that are in contact with the outer surfaces 38*a* and 39*a* are set in inner portions (spaces) of the through holes 62 and 63 by the aforementioned reaction force F.

Figure 13:
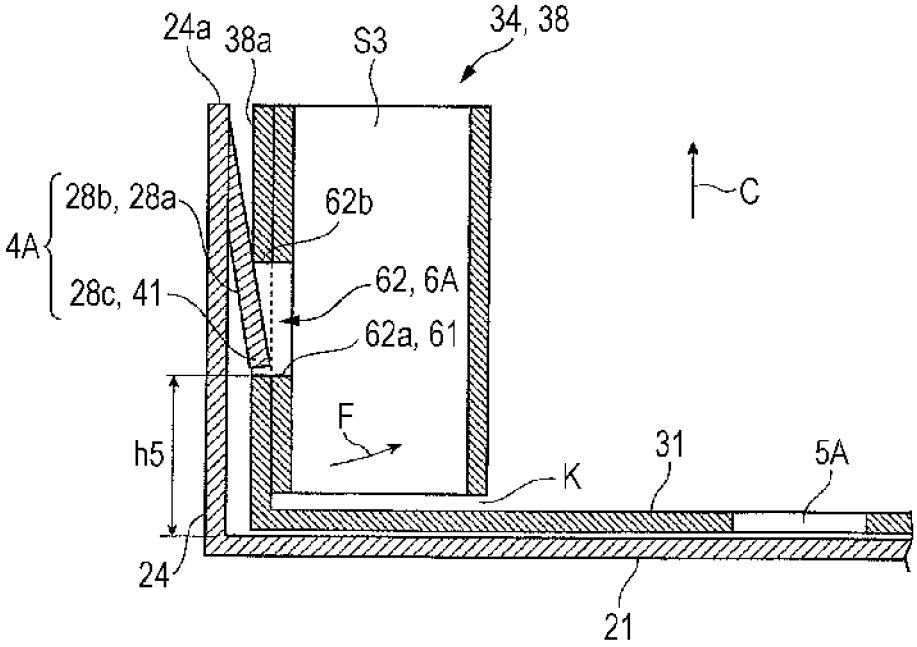
FIG. 13 is a sectional view illustrating a state in which the fitting operation shown in FIGS. 12A and 12B is completed.

As a result, as shown in FIG. 13, the lower sides 62*a* and 63*a* of the through holes 62 and 63 of the cushioning material 3 (that is, the portions 61 of the restrain portions 6A and 6B) oppose the end portions 28*c* and 29*c* of the projections 28*b* and 29*b* of the respective flaps 28 and 29 (that is, the portions 41 of the restrainers 4A and 4B) so as to be relatively positioned at the side of the bottom board 21 of the box body 2 and so as to abut upon the end portions 28*c* and 29*c*.

At this time, the lower sides 62*a* and 63*a* of the respective through holes 62 and 63 may be in contact with or separated from the end portions 28*c* and 29*c* of the respective projections 28*b* and 29*b*. As illustrated in FIG. 13, when they are separated, the outer surfaces of the projections 28*b* and 29*b* of the respective flanges 28 and 29 contact the upper sides 62*b* and 63*b* of the respective through holes 62 and 63. When the cushioning material 3 is moved in a direction C in which the cushioning material 3 is taken out from the accommodation space S1 of the box body 2, the lower sides 62*a* and 63*a* of respective through holes 62 and 63 are set so as to abut upon the end portions 28*c* and 29*c* of the projections 28*b* and 29*b*.

By the process up to this time, as shown in, for example, FIGS. 3, 4, and 13, the packaging box 1 in which the cushioning material 3 is fitted in the accommodation space S1 of the box body 2 is obtained.

The packaging box 1 at this time is one in which the storage space S2 surrounded by the four standing cushioning-material side surface sections 32 to 35 of the cushioning material 3 is newly formed in the accommodation space S1 of the box body 2. The storage space S2 has a shape defined by partly narrowing down a space by the second cushioning-material structural portion 37 at the upper side of the second cushioning-material side surface section 33. The first cushioning-material structural portion 36 at the first cushioning-material side surface section 32 is capable of being temporarily displaced to a retreating position (where the entrance of the storage space S2 is not covered) by the bending portion 32*b* so that the first cushioning-material structural portion 36 does not hinder the storing of the packaging object 100 in the storage space S2, and fills an open space that is formed above the packaging object 100 after performing packaging.

Figure 5:
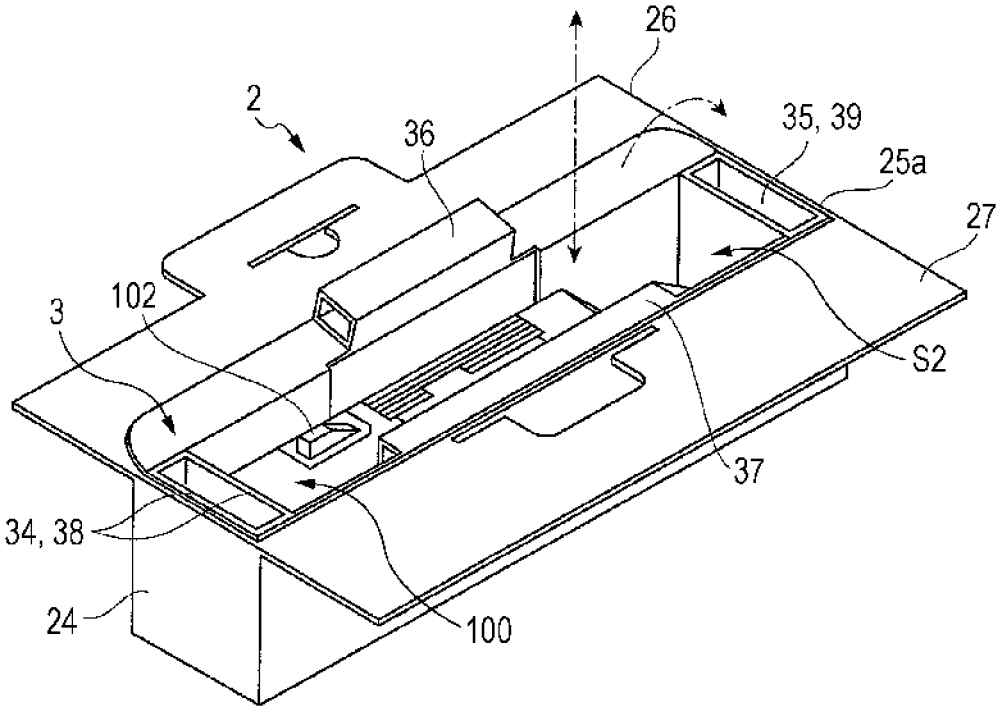
FIG. 5 is a perspective view showing a state of another packaging step using the packaging box shown in FIG. 1, that is, the step of accommodating a packaging object in the packaging box shown in FIG. 3.

Subsequently, as shown in FIG. 5, a person holds the packaging object 100 with his/her hands, lowers the packaging object 100 so that the packaging object 100 is fitted in an orientation for packaging, and stores the packaging object 100 in the storage space S2 of the packaging box 1. Next, as shown in FIG. 6, the first cushioning-material structural portion 36 at the first cushioning-material side surface section 32 of the cushioning material 3 is interposed in a gap between the packaging object 100 and the first side board 22 of the box body 2 (actually the side board portion 32*a* of the first cushioning-material side surface section 32 of the cushioning material 3) by inwardly bending the bending portion 32*b*.

Figure 6:
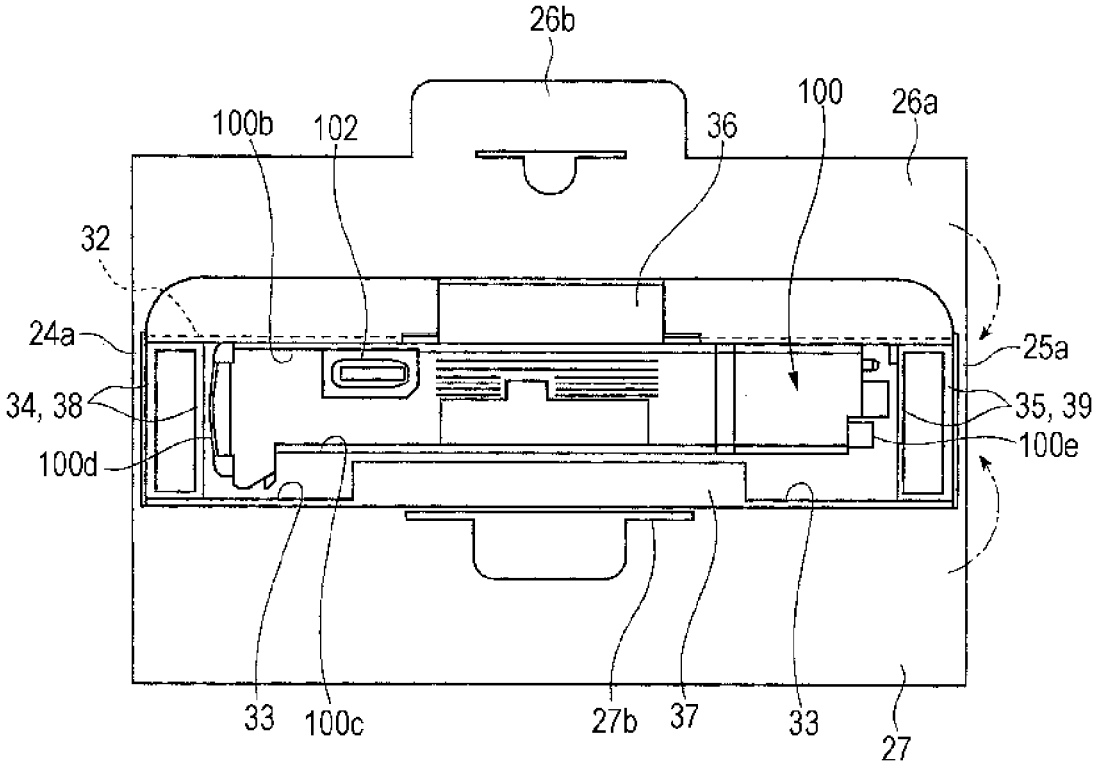
FIG. 6 is a top plan view of the packaging box shown in FIG. 5.

By this, as shown in, for example, FIG. 6, the bottom portion of the packaging object 100 is surrounded by the bottom surface section 31 of the cushioning material 3. In addition, left and right side portions 100*b* and 110*c* in a longitudinal direction of the packaging object 100 are surrounded by the first side surface section 32 (including the first cushioning-material structural portion 36) and the second side surface section 33 (including the second cushioning-material structural portion 37) of the cushioning material 3. Further, two side portions 100*d* and 100*e* in a short-side direction of the packaging object 100 are surrounded by the third side surface section 34 (the third cushioning-material structural portion 38) and the fourth side surface section 35 (the fourth cushioning-material structural portion 39). Although, the packaging object 100 has, for example, a projection 102 that is disposed at an upper portion thereof and that projects more than other portions thereof, the cushioning-material structural portions (members), such as the second cushioning-material structural portion 37, are designed so as not to contact such a projection 102.

Subsequently, after the second flap 27 (serving as the inner cover of the box body 2) is bent at the upper end 23*a* of the second side board 23 as shown by a dotted arrow shown in FIG. 6, and is closed so as to cover the upper portion of the packaging object 100, the first flap 26 (serving as the outer cover of the box body 2) is bent at the upper end 22*a* of the first side board 22 as shown by a dotted arrow shown in FIG. 6, and is closed so as to be placed upon the second flap 27. Lastly, the inserting portion 26*b* of the first flap 26 of the box body 2 is in a state in which it inserted in the insertion cutaway portion 27*b* of the second flap 27. At this time, the first cushioning-material structural portion 36 is interposed between the upper portion of the packaging object 100 and the second flap 27 and the upper portion of the packaging object 100 and the first flap 26.

By carrying out all of the above-described steps, the top portion of the accommodation space S1 and the top portion of the storage space S2 are covered by the second flap 27 and the first flap 26, serving as covers, so that the packaging using the packaging box 1 ends.

The cushioning material 3 is interposed between all of the inner walls of the box body 2 and the packaging object 100 that is packaged in the packaging box 1. Therefore, when the packaging box 1 receives, for example, an external shock when it is transported, etc., the shock is absorbed by the cushioning material 3. Consequently, the packaging object 100 that is packaged in the packaging box 1 is protected from such external shock.

Next, opening of the packaging box 1 will be described.

It is possible to open the packaging box 1 by carrying out the above-described packaging steps in the reverse order. That is, first, after removing the inserting portion 26*b* of the first flap 26 of the box body 2 from the insertion cutaway portion 27*b* of the second flap 27, the first flap 26 and the second flap 27 are opened in that order. By this, as shown in FIG. 6, a portion of the top portion of the packaging object 100 accommodated in the box body 2 of the packaging box 1 while being surrounded by the cushioning material 3 is visible in an exposed state to the outside.

Subsequently, by bending the bending portion 32*b* of the first cushioning-material surface of the cushioning material 3, the first cushioning-material structural portion 36 is retreated from the top portion of the packaging object 100 (see FIG. 5). By this, preparation is made for removing the packaging object 100 from the packaging box 1.

Thereafter, a person holds the packaging object 100 with his/her hands, lifts up the packaging object 100 from the accommodation space S1 of the packaging box 1 (actually, the storage space S2 of the cushioning material 3), and removes the packaging object 100 from the packaging box 1.

At this time, when a portion of the cushioning material 3 is directly in contact with a portion of the packaging object 100 or is indirectly in contact therewith through a packaging material, the cushioning material 3 may also be removed together with the packaging object 100 as the packaging object 100 is being removed. In addition, in the packaging box 1, the air holes 5A and 5B are formed in the bottom surface section 31 of the cushioning material 3 for easily fitting the cushioning material 3 into the accommodation space S1 of the box body 2. Therefore, when the cushioning material 3 needs to be taken out from the accommodation space S1 of the box body 2, outside air flows into the space E, formed between the bottom surface section 31 of the cushioning material 3 and the bottom board 21 of the box body 2, through the air holes 5A and 5B, so that it is possible to easily take out the cushioning material 3. That is, when the air holes 5A and 5B are not formed in the cushioning material 3, the space E is sealed. When only the cushioning material 3 is moved in the taking-out direction C and the space E is widened, the inside of the space E becomes temporarily vacuous, and may provide suction resistance when the cushioning material 3 is moved. However, since, in the cushioning material 3 defining the air holes 5A and 5B, such a suction resistance does not occur, it is possible to easily take out the cushioning material 3 from the accommodation space S1 of the box body 2. As a result, when the cushioning material 3 defining the air holes 5A and 5B contacts a portion of the packaging object 100 that is taken out, the cushioning material 3 is positioned integrally with the packaging object 100, and is taken out together with the packaging object 100 from the accommodation space S1 of the box body 2.

When the cushioning material 3 is subjected to an external force that moves it in the direction C in which the cushioning material 3 is taken out from the accommodation space S1 of the box body 2, as shown in FIG. 13, the following occurs in the packaging box 1. That is, the lower sides 62*a* and 63*a* (the portions 61 of the restrain portions 6A and 6B) of the through holes 62 and 63 of the cushioning-material structural portions 38 and 39 (which are formed at the third cushioning-material side surface section 34 and the fourth cushioning-material side surface section 35 of the cushioning material 3) abut upon the end portions 28*c* and 29*c* (the portions 41 of the restrainers 4A and 4B) of the projections 28*b* and 29*b* (which are formed at the flaps 28 and 29 of the corresponding third side board 24 and the fourth side board 25 of the box body 2). This causes the lower sides 62*a* and 63*a* (the portions 61) of the respective through holes 62 and 63 (serving as the restrain portions 6A and 6B) of the cushioning material 3 to be caught by the end portions 28*c* and 29*c* (the portions 41) of the projections 28*b* and 29*b* (serving as the restrainers 4A and 4B of the box body 2). Therefore, the movement of the cushioning material 3 in the taking-out direction C is prevented, as a result of which the cushioning material 3 is retained in the accommodation space S1 without being taken out from the accommodation space S1 of the box body 2.

Therefore, when the packaging box 1 is being opened, it is possible to take out only the packaging object 100 from the accommodation space S2 (formed by the cushioning material 3) while the cushioning material 3 is retained in the accommodation space S1 of the box body 2. At this time, the cushioning material 3 is not damaged. In addition, after taking out the packaging object 100 (including after taking out the packaging object 100 that is packaged without contacting the cushioning material 3), the cushioning material 3 is kept in a mounted state to the accommodation space S1 of the box body 2, and is not dismounted.

By carrying out the above-described steps, the opening of the packaging box 1 ends. When, in particular, the packaging box 1 is to be opened, the cushioning material 3 is in a fitted state in the accommodation space S1 of the box body 2 without being damaged. Therefore, for example, if the packaging object 100 is a replacement object (or product) that needs to be collected, when the used part (product) to be replaced is to be collected after accommodating and packaging the used part (product) in the packaging box 1, it is possible to reuse the packaging box 1. When the packaging box 1 is to be reused in this way, the cushioning material 3 is not taken out and lost during the opening of the packaging box. In addition, it is not necessary to perform the troublesome operation in which the cushioning material 3 that is removed during the opening of the packaging box is precisely reset in the accommodation space S1 of the box body 2. This makes it possible to easily properly repackage a packaging object, thereby making it convenient for a user.

On the other hand, when the packaging box 1 is to be disposed of after being opened, after taking out the cushioning material 3 from the accommodation space S1 of the box body 3, the box body 2 and the cushioning material 3 are broken down into very small pieces, to dispose of the packaging box 1.

At this time, the cushioning material 3 is removed in the following way. For example, a person inserts his/her fingers into inside spaces (for absorbing shock) S3 in the third cushioning-material structural portion 38 and the fourth cushioning-material structural portion 39, and pushes and displaces the projections 28*b* and 29*b* of the respective flaps 28 and 29 outward (that is, in the directions in which they approach the respective side boards 24 and 25) through the respective through holes 62 and 63 against the reaction force F. By this, the end portions 28*c* and 29*c* of the respective projections 28*b* and 29*b* (serving as the restrainers 4A and 4B) are in a state in which they do not abut upon the lower sides 62*a* and 63*a* of the respective through holes 62 and 63 (serving as the restrain portions 6A and 6B). Therefore, by moving the cushioning material 3 in the taking-out direction C in this state, it is possible to easily remove the cushioning material 3 from the accommodation space S1.

Modification of First Exemplary Embodiment

The flaps having the restrainers 4A and 4B at the box body 2 are not limited those including the body portions 28*a* and 29*a* and the projections 28*b* and 29*b* as with the flaps 28 and 29 discussed in the first exemplary embodiment (see, for example, FIGS. 8A and 8B). For example, the flaps may have the structures shown in FIGS. 14A to 15B.

Figure 14A:
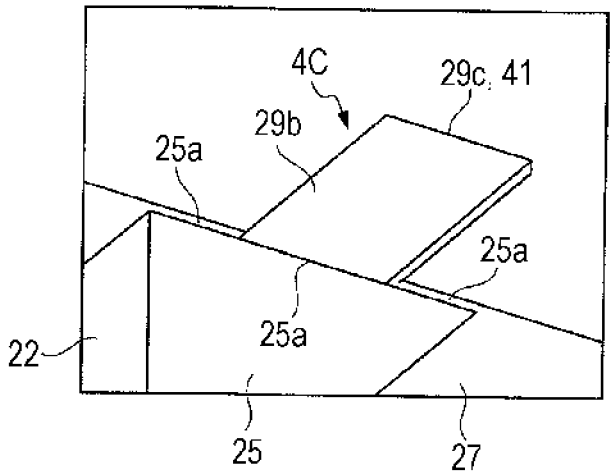
FIGS. 14A and 14B show another exemplary structure of the flap that is formed as a restrainer, with FIG. 14A being a perspective view of the structure of the flap, and FIG. 14B being a perspective view of a state in which the flap is bent.
Figure 14B:
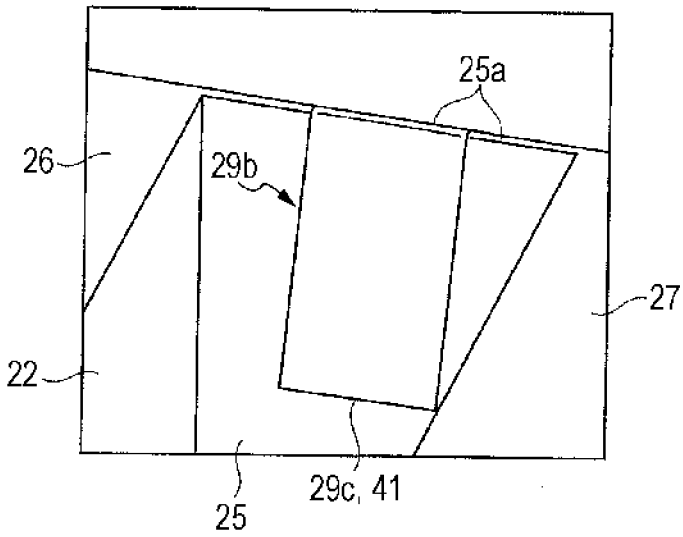

A flap 29 having a restrainer 4C illustrated in FIGS. 14A and 14B only includes a projection 29*b* and does not include a body portion 29*a*. In this structural example, a flap 28 disposed opposite to the flap 29 has the same structure (this also applies to the following structural example). In the structural example illustrated in FIGS. 14A and 14B, since the body portion 29*a* is not provided, the structure becomes simpler, but a restoring reaction force that is produced when the projection 29*b* is bent in the accommodation space S1 becomes weaker.

Figure 15A:
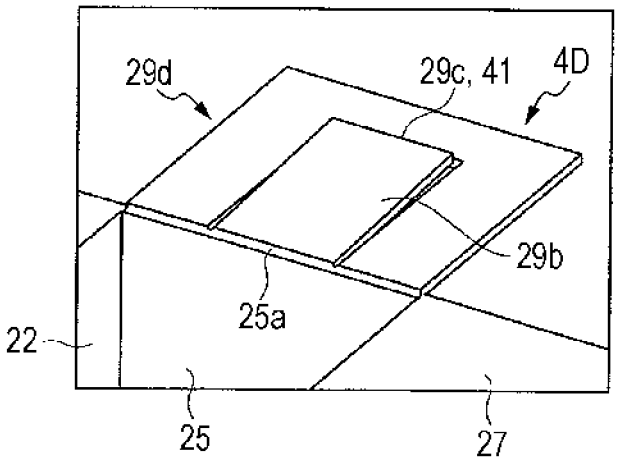
FIGS. 15A and 15B show another exemplary structure of the flap that is formed as a restrainer, with FIG. 15A being a perspective view of the structure of the flap, and FIG. 15B being a perspective view of a state in which the flap is bent.
Figure 15B:
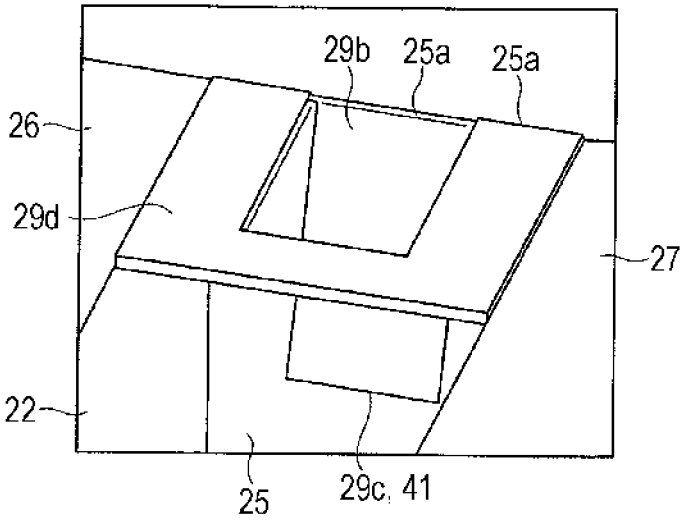

A flap 29 having a restrainer 4D illustrated in FIGS. 15A and 15B is formed by forming a body portion 29*d* having a size allowing it to surround the outer side of a projection 29*b*, and cutting a portion of the body portion 29*d* (that becomes the projection 29*b*). In the structural example illustrated in FIGS. 15A and 15B, as shown in FIG. 15B, only the projection 29*b* is used as the restrainer 4D during packaging, and the remaining body portion 29*d* may be made to exist between the packaging object 100 and the covers of the box body 2 so as to be used as a cushioning material and a cover.

The restrain portion 6 formed at the cushioning-material side surface section of the cushioning material 3 is not limited to that having a structure including the lower side 62*a* of the through hole 62 formed as the restrain portion 6A at the cushioning-material side surface section (that is, the cushioning-material structural portion 38) illustrated in the first exemplary embodiment (see, for example, FIG. 11). Accordingly, it is possible to apply, for example, the structures illustrated from FIGS. 16 to 20. These structures are similarly applicable to the restrain portion 6B formed at the cushioning-material side surface section 35 (that is, the cushioning-material structural portion 39) disposed opposite to the cushioning-material side surface section 34.

Figure 16:
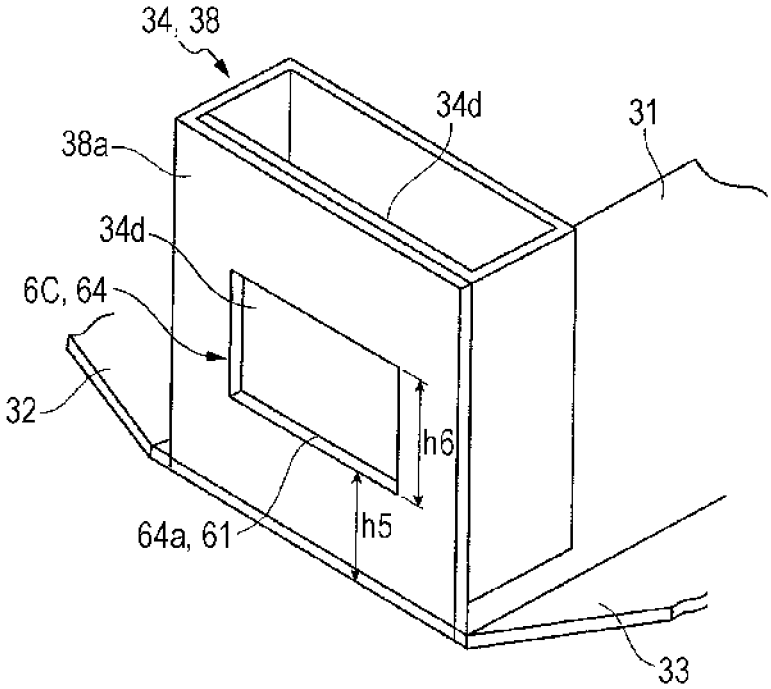
FIG. 16 is a perspective view of another exemplary structure of the restrain portion.
Figure 17:
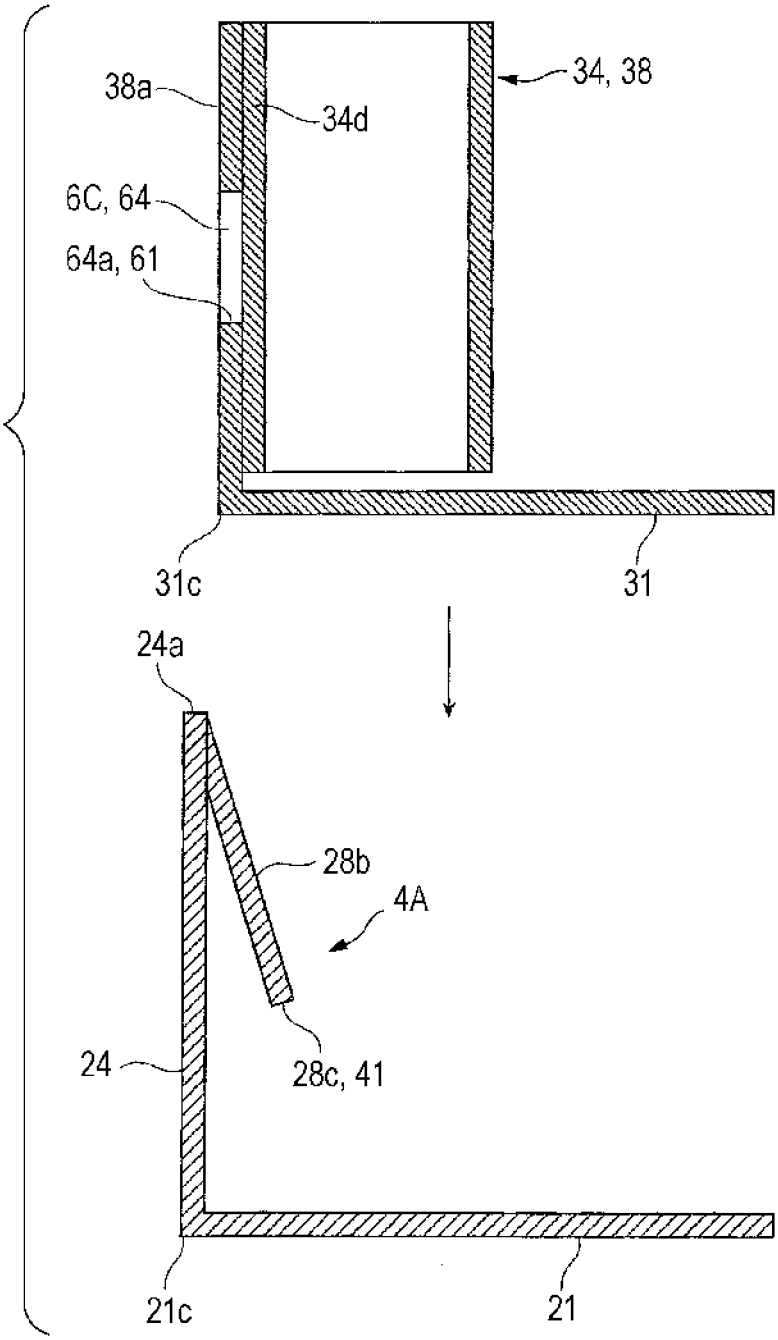
FIG. 17 is a sectional view illustrating a state of the fitting operation when the restrain portion shown in FIG. 16 and the restrainer shown in FIG. 8 are to be fitted to each other.
Figure 18:
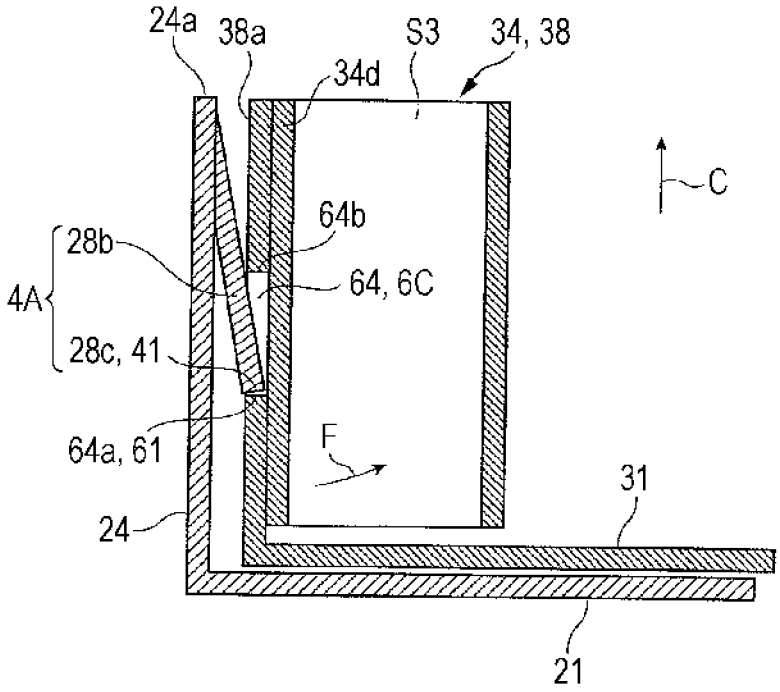
FIG. 18 is a sectional view illustrating a state in which the fitting operation shown in FIG. 17 is completed.
Figure 19A:
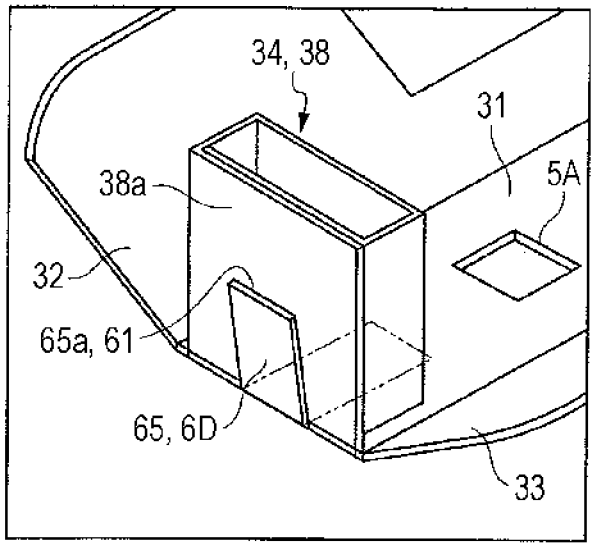
FIGS. 19A and 19B show another exemplary structure of the restrain portion, with FIG. 19A being a perspective view of the exemplary structure, and FIG. 19B being a sectional view of the exemplary structure.
Figure 19B:
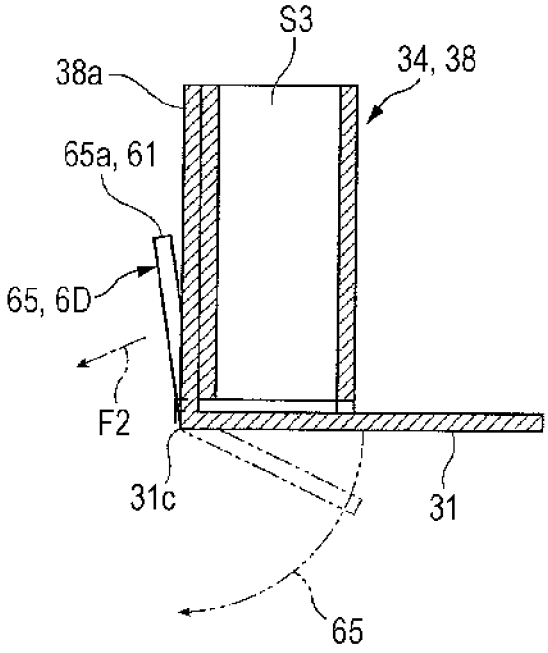
Figure 20:
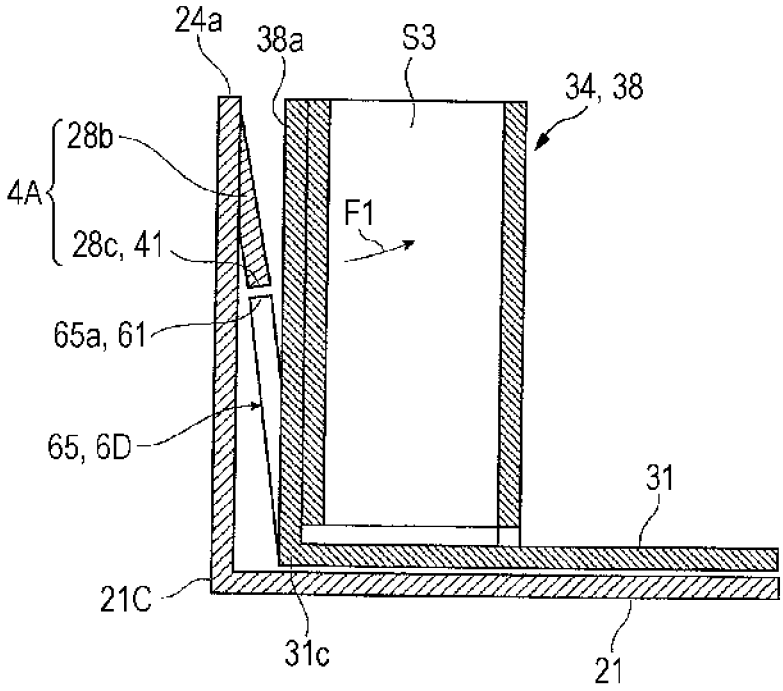
FIG. 20 is a sectional view illustrating a state in which the fitting operation when the restrain portion shown in FIGS. 19A and 19B is used is completed.

Restrain portions 6C shown from FIGS. 16 to 18 each have the following structure. That is, a rectangular opening 64 (that does not penetrate completely) is formed at an outermost side surface portion (corresponding to one corrugated cardboard portion) of an outer surface portion 38*a* at a double structure in the cushioning-material structural portion 38 of the cushioning-material side surface section 34. (A rectangular opening is not formed in an inner side surface portion 34*d*.) In addition, a lower side 64*a* of the opening 64 is used as a portion 61 of the restrain portion 6A. For example, the dimensions and a position of formation of the opening 64 may be the same as or different from those of the through holes 62.

As shown in FIG. 18, when the cushioning material 3 is fitted in the accommodation space S1 of the box body 2, the end portion 28*c* of the projection 28*b* of the flap 28 having the restrain portion 4A in the box body 2 is inserted in the opening 64, so that the restrain portion 6C is set in the following state. That is, the restrain portion 6C is such that the lower side 64*a* of the opening 64 that is positioned at the side of the bottom board 21 abuts upon and opposes the end portion 28*c*. Accordingly, even if an attempt is made to move the cushioning material 3 in the taking-out direction C, the lower side 64*a* of the opening 64 (serving as the restrain portion 6C) abuts upon the end portion 28*c* of the projection 28*b* of the flap 28 (serving as the restrainer 4A), so that the movement of the cushioning material 3 is prevented. Therefore, the cushioning material 3 is retained in the accommodation space S1 without being removed. A range of displacement of the end portion 28*a* of the projection 28*b* of the flap 28 is restricted by the inner side surface portion 34*d* that covers the opening 64 from one side in the restrain portion 6C constituted by the opening 64 that does not penetrate completely. Therefore, for example, the end portion 28*a* is not displaced to a position situated away from the lower side 64*a* of the opening 64, so that the state in which the end portion 28*a* and the lower side 64*a* oppose each other is stably maintained.

On the other hand, when the cushioning material 3 is to be taken out from the accommodation space S1, for example, the following operations are performed. That is, a thin member or a plate-shaped member is inserted in a gap between the outer surface 38*a* of the cushioning-material structural portion 38 of the cushioning-material side surface section 34 and the projection 28*b* of the flap 28, to displace the projection 28*b* towards the side board 24. This causes the end portion 28*c* to be displaced to a position where the end portion 28*c* does not abut upon the lower side 64*a* of the opening 64, so that the cushioning material 3 may be moved upward in the taking-out direction C.

The restrain portions 6D shown from FIGS. 19A to 20B each have the following structure. That is, a rectangular projection 65 that projects outward from the outer surface 38*a* of the cushioning-material structural portion 38 of the cushioning-material side surface section 34 is formed, and an end portion 65*a* of the projection 65 is used as a portion 61 of the restrain portion 6A. For example, the projection 65 is formed by cutting a portion of the bottom surface section 31 in the form of a projection as indicated by an alternate long and two short dash line in FIGS. 19A and 19B, and bending the cut portion along the short side 31*c* of the bottom surface section 31 until the cut portion is close to and opposes the outer surface 38*a* of the cushioning-material structural portion 38. The projection 65 formed in this way generates a reaction force F2 that tries to restore it in a direction in which it moves away from the outer surface 38*a* of the cushioning-material structural portion 38 (see FIG. 19B).

Figure 22:
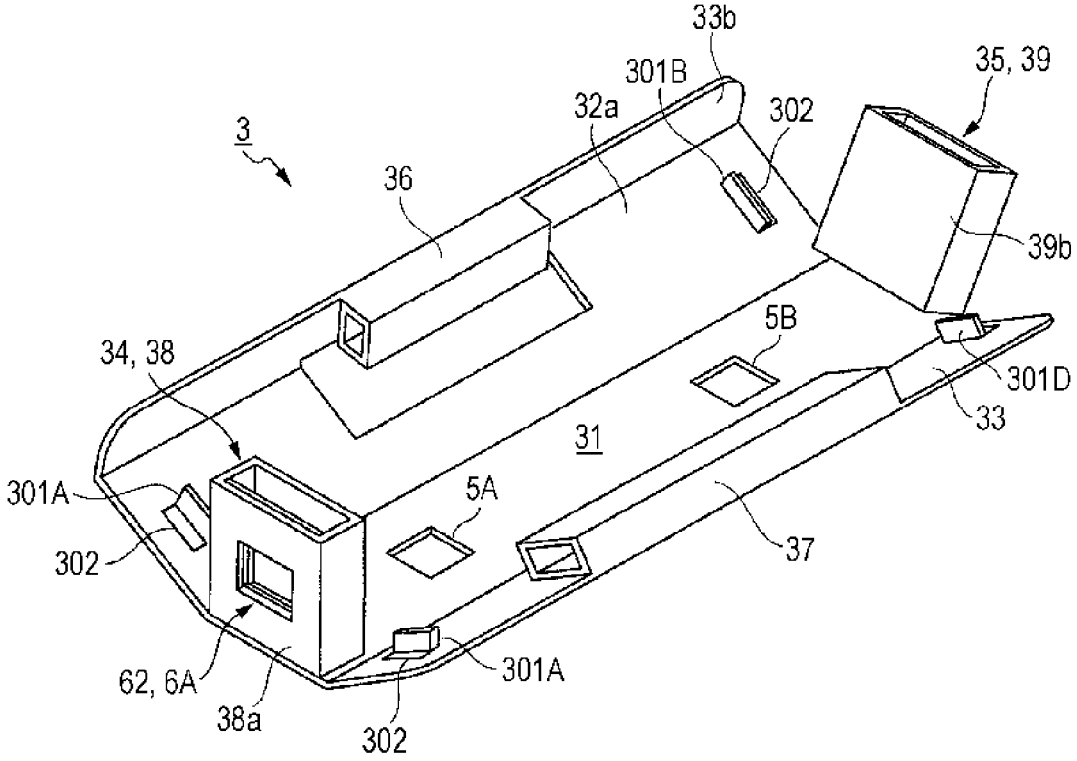
FIG. 22 is a perspective view of another exemplary structure of the cushioning material.
Figure 23:
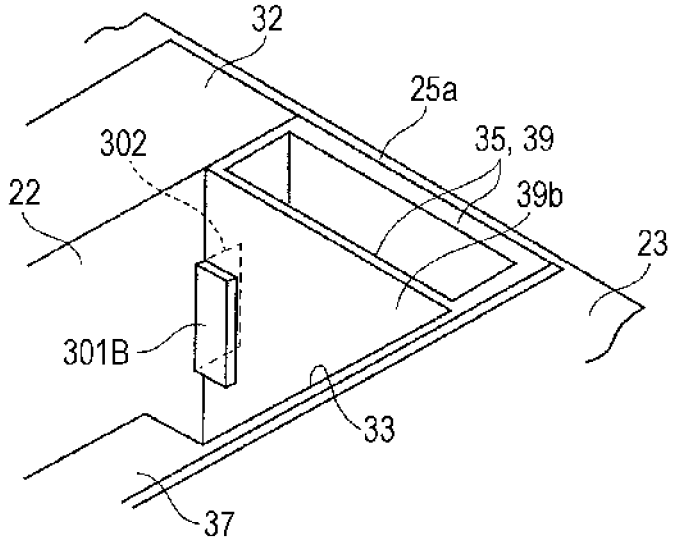
FIG. 23 is a perspective view of a state in which a principal portion (tilting preventing portion) of the cushioning material shown in FIG. 22 is used.
Figure 24:
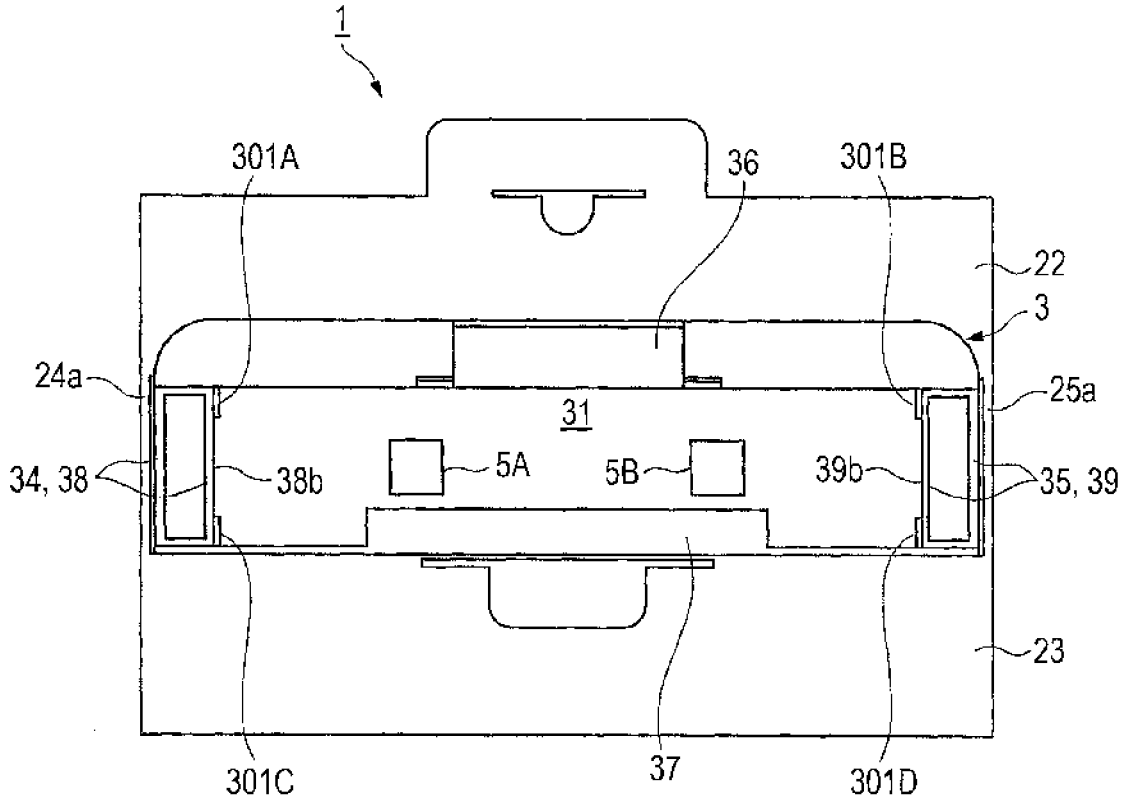
FIG. 24 is a plan view of the state in which the principal portion of the cushioning material shown in FIG. 22 is used.
Figure 25:
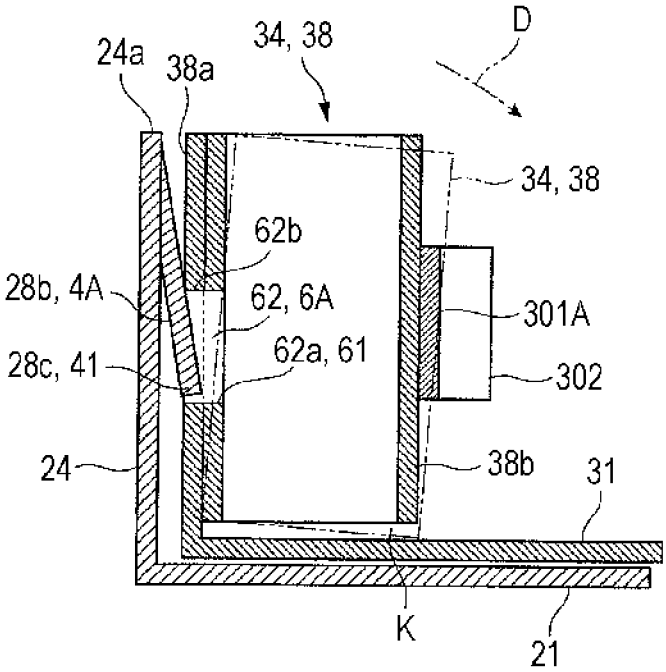
FIG. 25 is a sectional view of the state in which the principal portion of the cushioning material shown in FIG. 22 is used.

As shown in FIG. 22, when the cushioning material 3 is fitted in the accommodation space S1 of the box body 2, the end portion 28*c* of the projection 28*b* of the flap 28 having the restrainer 4A of the box body 2 is displaced above the end portion 65*a* of the projection 65*a* by the reaction force F1 when the end portion 28*c* passes the end portion 65*a* of the projection 65. As a result, the end portion 65*a* of the projection 65*a* abuts upon and opposes the end portion 28*c* of the projection 28*b* while the end portion 65*a* is positioned at the side of the bottom board 21. Therefore, even if an attempt is made to move the cushioning material 3 in the taking-out direction C, the end portion 65*a* of the projection 65 (serving as the restrain portion 6D) abuts upon the end portion 28*c* of the projection 28*b* of the flap (serving as the restrainer 4A), so that the movement of the end portion 65*a* is prevented. Consequently, the cushioning material 3 is retained in the accommodation space S1 without being removed. When the cushioning material 3 is to be taken out from the accommodation space S1, for example, operations that are the same as those carried out using the restrain portion 6C are performed.

Figure 21A:
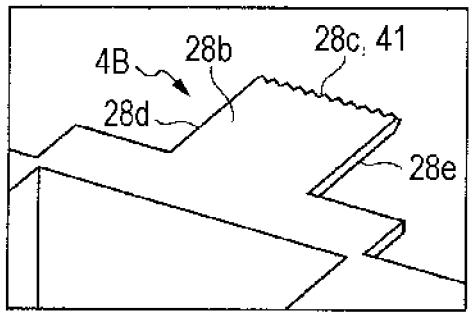
FIGS. 21A and 21B show other exemplary structures of the restrainer and the restrain portion, with FIG. 21A being a perspective view of the exemplary structure of the restrainer, and FIG. 21B being a perspective view of the exemplary structure of the restrain portion.
Figure 21B:
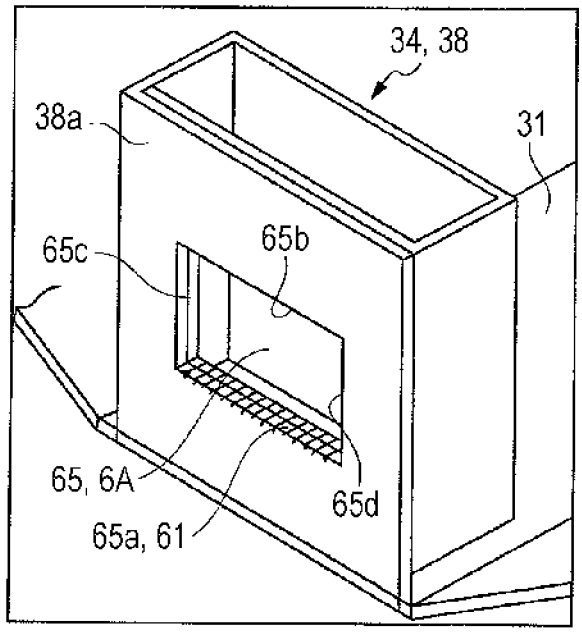

Although, the end portion 28*c* of the projection 28*b* constituting the portion 41 of the restrainer 4 and the lower side 62*a* of the through hole 62 constituting the portion 61 of the restrain portion 6 (as well as the lower side 64*a* of the opening 64 and the end portion 65*a* of the projection 65) are formed as straight end portions, the end portions may be formed as end portions that are wavy and finely uneven (portions indicated by wavy lines or by oblique lines) as shown in FIGS. 21A and 21B.

In this case, when the cushioning material 3 is moved in the taking-out direction C, friction force that is generated when the end portion 28*c* of the projection 28*b* (serving as the portion 41 of the restrainer 4) and the lower side 62*a* of the through hole 62 (serving as the portion 61 of the restrain portion 6) abut upon each other is larger than that when straight end portions are used. Accordingly, the end portion 28*c* and the lower side 62*a* do not tend to be removed from each other. Therefore, it is possible to stably maintain the state in which the end portion 28*c* and the lower side 62*a* abut upon each other. As a result, a state in which the cushioning material 3 is not easily removed from the accommodation space S1 of the box body 2 is stably obtained. In addition, as shown in FIGS. 21A and 21B, if a left end portion 28*d* and a right end portion 28*e* of the projection 28 and a left side portion 65*c* and a right side portion 65*d* of the through hole 65 are contacted when the end portion 28*c* and the lower side 62*a* abut upon each other, at least end portions that are contacted may be similarly formed so as to be finely uneven.

As shown from FIGS. 22 to 25, the cushioning material 3 may be provided with tilting preventing portions 301 that prevent the cushioning-material side surface sections 34 and 35 (the cushioning-material structural portions 38 and 39) having the restrain portions 6A and 6B from tilting in a direction D in which the cushioning-material side surface sections 34 and 35 move away from the end portions 28*c* and 29*c* of the respective projections 28*b* and 29*b* (serving as the restrainers 4A and 4B), that is, in a direction in which they move towards the bottom surface section 31.

The tilting preventing portions 301A to 301D (a total of four tilting preventing portions) shown in, for example, FIG. 22 are formed at the cushioning-material side surface sections 32 and 33 adjacent to the cushioning-material side surface sections 34 and 35 having the restrain portions 6A and 6B, two on the cushioning-material side surface section 32 and the other two on the cushioning-material side surface section 33. The tilting preventing portions 301 are formed by forming C-shaped cuts in portions of the cushioning-material side surface sections 32 and 33 and bending resulting flaps inwardly and upward. The tilting preventing portions 301 are formed so that they contact outer surfaces 38*b* and 39*b* at the inner sides of the cushioning-material structural portions 38 and 39 of the cushioning-material side surface sections 34 and 35 when the cushioning material 3 is fitted in the accommodation space S1 of the box body 2. More specifically, the tilting preventing portions 301 are formed so that slits (lines) 302 oppose the respective side surfaces of the cushioning-material structural portions 38 and 39 of the cushioning-material side surface sections 34 and 35, and the bent portions (bent flaps) are disposed close to the outer surfaces 38*b* and 39*b* at the inner sides of the cushioning-material structural portions 38 and 39 (see FIG. 23).

When the cushioning material 3 is to be fitted in the accommodation space S1 of the box body 2, the tilting preventing portions 301A to 301D are in a state in which they are bent upward and substantially vertically with respect to the inner surfaces of the cushioning-material side surface sections 32 and 33. Then, when the cushioning material 3 is fitted in the accommodation space S1, the four cushioning-material side surface sections 32 to 34 are raised with respect to the bottom surface section 31, so that the tilting preventing portions 301A to 301D are in a state in which they are capable of contacting the respective outer surfaces 38*b* and 39*b* at the inner sides of the cushioning-material structural portions 38 and 39 of the cushioning-material side surface sections 34 and 35. Therefore, as shown in, for example, FIG. 25, when the cushioning-material structural portions 38 and 39 of the cushioning-material side surface sections 34 and 35 are formed apart from the bottom surface section 31 by a gap k, the cushioning-material structural portions 38 and 39 may become tilted in a direction of arrow D by an amount corresponding to the gap k. However, the tilting is prevented by the tilting preventing portions 301A to 301D. The direction D is a direction in which the cushioning-material structural portions 38 and 39 move away from the side board 24 of the box body and move towards the bottom surface section 31 (that is, become set in a state indicated by an alternate long and two short dash line). That is, when, for example, the cushioning-material structural portion 38 is tilted as indicated above, the lower side 62*a* of the through hole 62 of the restrain portion 6A of the cushioning-material structural portion 38 (that is, the portion 61 of the restrain portion 6A) is set in a state in which the lower side 62 moves away from the end portion 28*a* of the projection 28 of the restrainer 4A of the flap 28 of the side board 24 and does not oppose the end portion 28*a* in such a way as to abut thereupon (or is removed when it abuts upon the projection 28). Therefore, the mechanism that prevents the cushioning material 3 of the box body 2 from being removed from the accommodation space S1 may no longer function. However, since the above-described tilting of the cushioning-material structural portion 38 is prevented from occurring by the tilting preventing portion 301A, the problem that the mechanism no longer functions does not occur.

Figure 26:
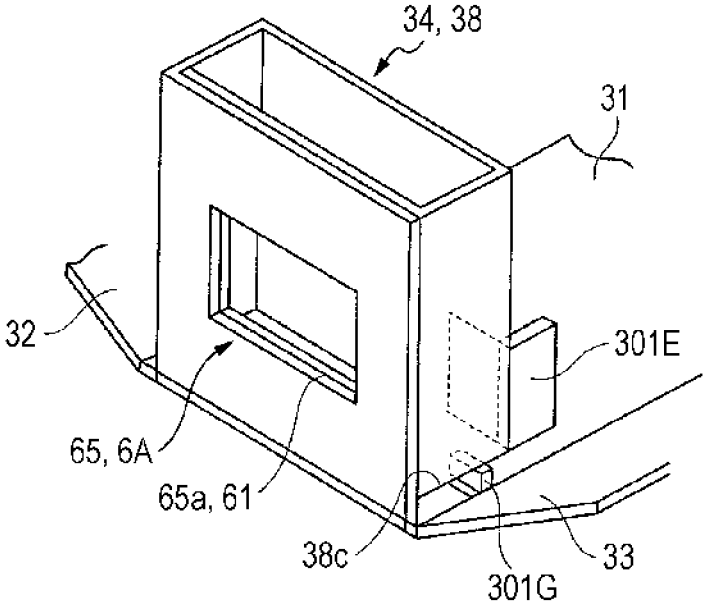
FIG. 26 is a perspective view of another exemplary structure of the tilting preventing portion formed at the cushioning material.

As with a tilting preventing portion 301E illustrated in FIG. 26, the tilting preventing portions 301 may be directly formed at the cushioning-material structural portion 38 and 39 of the cushioning-material side surface sections 34 and 35 provided with the restrain portions 6. Alternatively, as with a tilting preventing portion 301G, the tilting preventing portions 301 may be formed at the bottom surface section 31 that oppose lower ends 38*c* of the cushioning-material structural portions 38 and 39 of the cushioning-material side surface sections 34 and 35 provided with the restrain portions 6.

The tilting preventing portion 301E is used by bending a partly cutaway portion of the outer surface 38*b* at the inner side of the cushioning-material structural portion 38 vertically with respect to the outer surface 38*b*. In this case, when the cushioning-material structural portion 38 is on the verge of falling down towards the bottom surface section 31 in the direction D, a lower portion of an end of the tilting preventing portion 301E previously contacts the bottom surface section 31, and prevents the cushioning-material structural portion 38 from falling down. On the other hand, the tilting preventing portion 301G is used by bending a partly cutaway portion of the bottom surface section 31, opposing the lower end 38*c* of the cushioning-material structural portion 38, vertically with respect to the bottom surface section 31. That is, the tilting preventing portion 301G is set so that, when it is bent, its height is equal to the gap k. In this case, when the cushioning-material structural portion 38 is on the verge of falling down towards the bottom surface section 31 in the direction D, the lower end 38*c* contacts an upper end of the tilting preventing portion 301G, so that the cushioning-material structural portion 38 is prevented from falling down.

Figure 27:
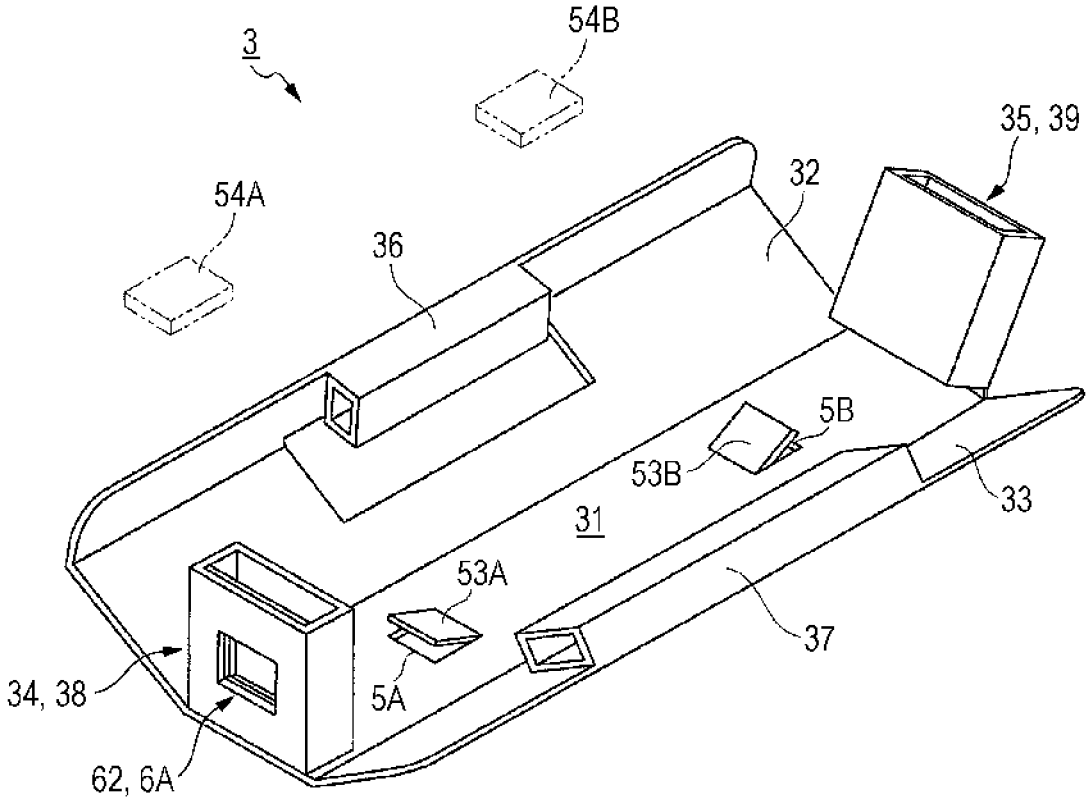
FIG. 27 is a perspective view of still another exemplary structure of the cushioning material.
Figure 28A:
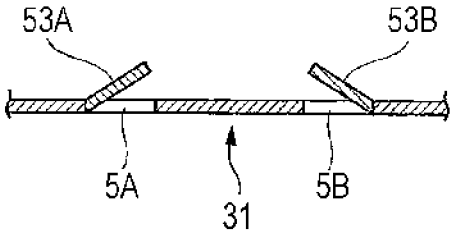
FIGS. 28A and 28B show, for example, the structure of a principal portion (covers) of the cushioning material shown in FIG. 27, with FIG. 28A being a sectional view of the structure of the covers and FIG. 28B being a sectional view illustrating the state of use of the covers.
Figure 28B:
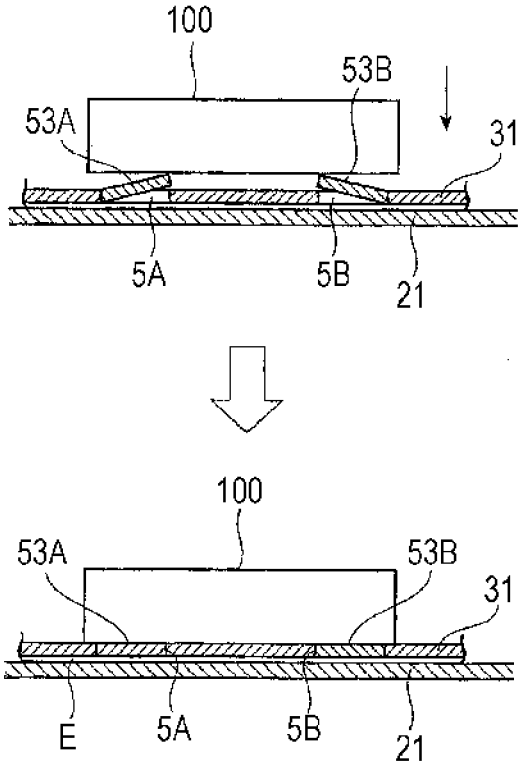

As shown in FIGS. 27 to 28B, the bottom surface section 31 of the cushioning material 3 may be provided with covers 53A and 53B that cover the air holes 5A and 5B.

The covers 53A and 53B are formed by forming C-shaped cuts in portions of the bottom surface section 31 where the air holes 5A and 5B are to be formed and by bending resulting flaps upward. Openings that appear in the bottom surface section 31 after raising the flaps are the air holes 5A and 5B. Therefore, the shapes and dimensions of the covers 53A and 53B are the same as those of the air holes 5A and 5B. In this case, the covers 53A and 53B (that is, the air holes 5A and 5B) may be set where a portion of the bottom portion of the packaging object 100 is capable of contacting and pushing downward the covers 53A and 53B.

In the case where the covers 53A and 53B are formed, when the cushioning material 3 is fitted in the accommodation space S1 of the box body 2, the covers 53A and 53B are set so that the air holes 5A and 5B are open, so that the cushioning material 3 is capable of being easily fitted in the accommodation space S1 due to the aforementioned reason. When the packaging object 100 is accommodated in the accommodation space S2 (formed by the cushioning material 3), either of the following is performed. That is, the covers 53A and 53B are previously displaced with one's hand, so that the air holes 5A and 5B are in a closed state; or, by accommodating the packaging object 100, a portion of the bottom portion of the packaging object 100 is made to contact and to push down the covers 53A and 53B, so that the air holes 5A and 5B are in a closed state. The latter case is effective because the closing operations of the covers 53A and 53B are performed in response to the accommodation of the packaging object 100. In this way, the air holes 5A and 5B almost completely prevent air flow.

On the other hand, when, in opening the packaging box 1, the cushioning material 3 is moved in the direction in which the cushioning material 3 is pulled out from the accommodation space S1 of the box body 2, the air holes 5A and 5B are covered by the covers 53A and 53B. Therefore, external air from the air holes 5A and 5B does not flow into the space E between the bottom surface section 31 of the cushioning material 3 and the bottom board 21 of the box body 2. Therefore, due to this reason also, the cushioning material 3 is not easily taken out from the accommodation space S1 as when the air holes 5A and 5B are not formed in the cushioning material 3. Consequently, the cushioning material 3 is not taken out from the accommodation space S1 of the box body 2, and tends to be retained in the accommodation space S1. That is, even in this case, a removal prevention function by the restrainer 4 and the restrain portion 6 is similarly realized, thereby preventing the cushioning material 3 from being taken out from the accommodation space S1.

As illustrated in FIG. 27, covers that cover the air holes 5A and 5B may be provided and applied as the covers 54A and 54B that are provided separately from the cushioning material 3. When the cushioning material 3 is to be taken out from the accommodation space S1, after moving or removing the covers 53 and 54 that cover the air holes 5A and 5B, it is possible to perform required procedures such as those mentioned above, to take out the cushioning material 3.

Figure 29:
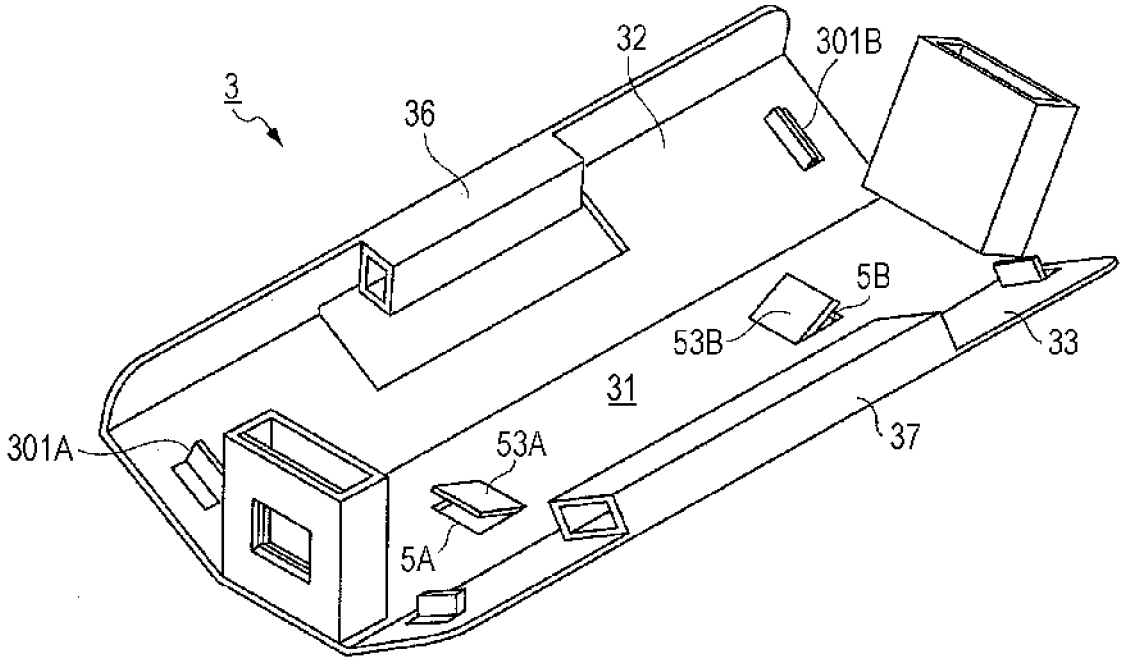
FIG. 29 is a perspective view of still another exemplary structure of the cushioning material.

As illustrated in FIG. 29, the tilting preventing portions 301 and the covers 53 (54) are applicable at the same time. This case is effective because it is possible to obtain the effects of the tilting preventing portions 301 and those of the covers 53.

Second Exemplary Embodiment

Figure 30:
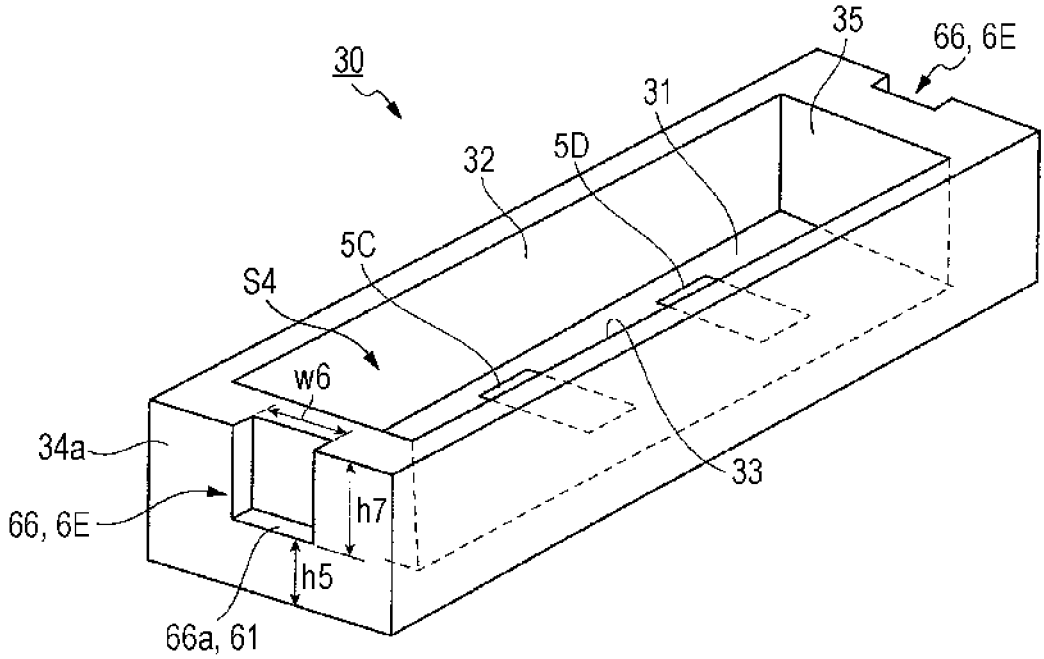
FIG. 30 is a perspective view of a cushioning material constituting a packaging box according to a second exemplary embodiment of the present invention.
Figure 31:
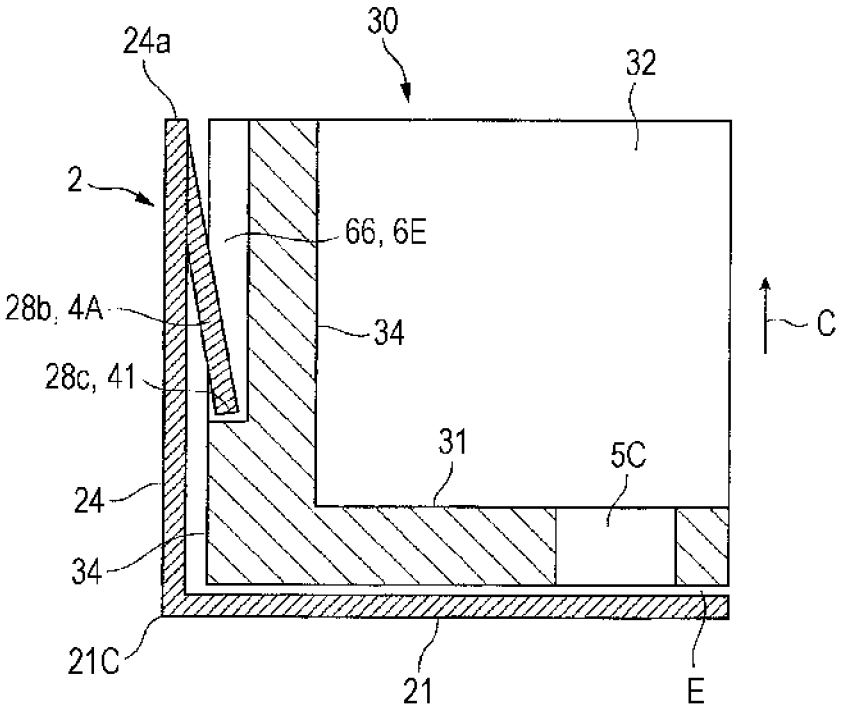
FIG. 31 is a sectional view illustrating a state in which a fitting operation is completed in the packaging box to which the cushioning material shown in FIG. 30 is applied.

FIGS. 30 and 31 show a packaging box 1 according to a second exemplary embodiment of the present invention. FIG. 30 shows a cushioning material 30 constituting the packaging box 1. FIG. 31 shows a state of a principal portion when the cushioning material 30 constituting the packaging box 1 is fitted in an accommodation space S1 of a box body 2. Structural portions that are common to those of the packaging box 1 according to the first exemplary embodiment will hereunder be given the same reference numerals (including those in the figures). In addition, the common structural portions will not be described unless they need to be described. These points also similarly apply to each of the following embodiments.

The cushioning material 3 (see, for example, FIGS. 2, 7, and 8) according to the first exemplary embodiment is similarly used in the box body 2 constituting the packaging box 1 according to the second exemplary embodiment. Therefore, as in the first exemplary embodiment, in the box body 2, flaps 28 and 29 are provided with projections 28*b* and 29*b* serving as restrainers 4A and 4B (see, for example, FIG. 8). In addition, as shown in FIG. 30, a structural material (such as a molded styrofoam material) is used as the cushioning material 30 constituting the packaging box 1. The structural material is formed of a shock-absorbing material (such as styrofoam) by forming the shock-absorbing material into the shape of a box previously having an open top.

The cushioning material 30 has four cushioning-material side surface sections 32 to 35 standing from respective sides of a bottom surface section 31 whose planar surface is rectangular. The cushioning material 30 is a structural material used for cushioning and used by fitting it into the accommodation space S1 of the box body 2 at least during packaging, and by causing it to exist between the box body 2 and a packaging object 100 that is accommodated in the accommodation space S1. The cushioning material 30 is formed by molding a styrofoam material into a predetermined shape. Therefore, the bottom surface section 31 and the cushioning-material side surface sections 32 to 35 provide a cushioning performance by making use of a shock-absorbing property of the styrofoam material itself (that depends upon the thickness and shape thereof). The inner surfaces of the bottom surface section 31 and the four cushioning-material side surface sections 32 to 35 are provided with cushioning-material structural portions (such as projections) that are formed on the basis of conditions such as positions, dimensions, and shapes in accordance with the external shape of the packaging object 100. In addition, for example, the dimensions (excluding the thicknesses) of the bottom surface section 31 and the four cushioning-material side surface sections 32 to 35 are substantially the same as those of the bottom surface section 31 and the four side surface sections 32 to 35 of the cushioning material 3 according to the first exemplary embodiment.

Air holes 5C and 5D are also formed in the bottom surface section 31 of the cushioning material 30. The air holes 5C and 5D may be formed under the same conditions as those of the air holes 5A and 5B according to the first exemplary embodiment.

Further, even in the cushioning material 30, the third cushioning-material side surface section 34 and the fourth cushioning-material side surface section 35 oppose a restrainer 4A of the third flap 28 and a restrainer 4B of the fourth flap 29 of the box body 2, respectively, when the cushioning material 30 is fitted in the accommodation space S1 of the box body 2. Therefore, restrain portions 6E provided with portions 61 are formed in the respective side surface sections 34 and 35. When the cushioning material 30 is fitted in the accommodation space S1 of the box body 2, the portions 61 oppose the portions 41 so as to be positioned at the side of a bottom board 21 of the box body 2 and so as to abut upon portions 41 of the restrainers 4A and 4B.

The restrain portions 6E are structural portions (rectangular hollow portions) 66. When viewed from the front sides of upper portions of outer surfaces 34*a* of the third and fourth cushioning-material side surface sections 34 and 35, the structural portions 66 have overall hollow forms whose upper ends are open and whose openings are rectangular. Lower sides 66*a* of the rectangular hollow portions 66 are formed so as to be used as the portions 61 that oppose the portions 41 of the restrainers 4A and 4B.

The rectangular hollow portions 66 (serving as the restrain portions 6E) are such that heights h5 of the lower sides 66*a* from the bottom surface section 31 and opening widths w6 are equal to the heights h5 and the opening widths w6 of the through holes 62, etc., according to the first exemplary embodiment. In addition, the rectangular hollow portions 66 are such that opening heights h7 are equal to values obtained by subtracting the heights h5 of the lower sides 66*a* of the hollow portions 66 from a height H of the side board 24 (that is, H-h5). The opening widths w6 of the hollow portions 66 are also set wider than the widths of the projections 28*b* and 29*b* serving as the restrainers 4A and 4B. Therefore, end portions of the projections 28*b* and 29*b* are capable of entering the hollow portions 66.

In packaging using the packaging box 1 to which the cushioning material 30 is applied, as with the packaging box 1 according to the first exemplary embodiment, first, the cushioning material 30 is set in a fitted state in the accommodation space S1 of the box body 2.

That is, after the flaps 28 and 29 provided with the restrainers 4A and 4B of the box body 2 are set in a bent state so as to exist in the accommodation space S1 (see FIGS. 2 and 8B), the cushioning material 30 is fitted into the accommodation space S1 of the box body 2 that is set in this state. At this time, the shape of the bottom surface section 31 of the cushioning material 30 is the same as that of the bottom board 21 of the box body 2, whereas its dimensions (long-side and short-side dimensions) are slightly smaller than those of the bottom board 21. Even, in the cushioning material 30, the air holes 5C and 5D are formed in the bottom surface section 31. Therefore, as with the fitting of the cushioning material 30 according to the first exemplary embodiment, the fitting of the cushioning material 30 into the accommodation space S1 of the box body 2 is easily carried out without receiving the resistance of air existing in a space E between the bottom surface section 31 of the cushioning material 30 and the bottom board 21 of the box body 2.

In the process of fitting the cushioning material 30 into the accommodation space S1 of the box body 2, when the cushioning material 30 is fitted into the accommodation space S1 of the box body 2 until the bottom surface section 31 of the cushioning material 30 contacts the bottom board 21 of the box body 2, the following occurs. That is, when end portions 28*c* and 29*c* of the projections 28*b* and 29*b* of the respective flaps 28 and 29 oppose the hollow portions 66 formed in the respective cushioning-material side surface sections 34 and 35, the end portions 28*c* and 29*c* of the projections 28*b* and 29*b* of the respective flaps 28 and 29 that are in contact with the outer surfaces 34*a* and 35*a* are set in spaces of the hollow portions 66 by the aforementioned reaction force F.

As a result, as shown in FIG. 31, the lower sides 66*a* of the hollow portions 66 of the cushioning material 30 (that is, the portions 61 of the restrain portions 6E) oppose the end portion 28*c* of the projection 28*b* of the flap 28 and the end portion 29*c* of the projection 29*b* of the flap 29 (that is, the portions 41 of the restrainers 4A and 4B) so as to be relatively positioned at the side of the bottom board 21 of the box body 2 and so as to abut upon the end portions 28*c* and 29*c*. This sets the cushioning material 30 in a fitted state in the accommodation space S1 of the box body 2.

The packaging at this time is completed when the first flap 26 and the second flap 27 of the box body 2 are closed after storing the packaging object 100 in a storage space S4 (see FIG. 30) surrounded by the bottom surface section 31 and the four cushioning-material side surface sections 32 to 35 of the cushioning material 30. Incidentally, the cushioning material 30 is interposed between the packaging object 100 (which is packaged using the packaging box 1) and the inside walls other than the upper inside wall of the box body 2. For this reason, when the packaging box 1 receives, for example, an external shock during the transportation of the packaging box 1, the shock is absorbed and cushioned by the cushioning material 30. The packaging object 100 that is packaged using the packaging box 1 is protected from such external shock.

On the other hand, it is possible to open the packaging box 1 by carrying out the above-described packaging steps in the reverse order.

Among these steps, when a person holds the packaging object 100 with his/her hands, lifts up the packaging object 100 from the accommodation space S1 of the packaging box 1 (actually, the storage space S4 formed by the cushioning material 30), and takes out the packaging object 100 from the packaging box 1, only the packaging object 100 is capable of being taken out from the storage space S4 (formed by the cushioning material 30) while the cushioning material 3 is retained in the accommodation space S1 of the box body 2.

That is, as shown in FIG. 31, when the cushioning material 30 is subjected to an external force that moves the cushioning material 30 in the direction C in which the cushioning material 30 is taken out from the accommodation space S1 of the box body 2, the lower sides 66*a* of the respective hollow portions 66 (that is, the portions 61 of the restrain portions 6A and 6B) of the third and fourth cushioning-material side surface sections 34 and 35 of the cushioning material 30 are in a state in which they abut upon the end portions 28*c* and 29*c* (that is, the portions 41 of the respective restrainers 4A and 4B) of the projections 28*b* and 29*b* of the flaps 28 and 29 of the box body 2. By this, the lower surfaces 66*a* (that is, the portions 61) of the hollow portions 66 serving as the restrain portions 6E of the cushioning material 30 are in a state in which they are caught by the end portions 28*c* and 29*c* (that is, the portions 41) of the projections 28*b* and 29*b* serving as the respective restrainers 4A and 4B of the box body 2. As a result, the cushioning material 30 is prevented from moving in the taking-out direction C, and is in a state in which it is retained in the accommodation space S1 without being removed from the accommodation space S1 of the box body 2.

By this, the opening of the packaging box 1 according to the second exemplary embodiment ends. In particular, if the packaging box 1 is to be opened, when the cushioning material 30 exists in a state in which it is fitted in the accommodation space S1 of the box body 2 without the cushioning material 30 being damaged, it is possible to reuse the packaging box 1 as with the packaging box 1 according to the first exemplary embodiment.

When it is necessary to remove the cushioning material 30 from the accommodation space S1 of the box body 2 of the packaging box 1, for example, a plate-like member is inserted into the gap between the hollow portions 66 and the side board 24 and 25 of the box body 2, and the projections 28*b* and 29*b* of the respective flaps 28 and 29 are pushed and displaced outward (that is, in the direction in which they move towards the side boards 24 and 25) against the reaction force F. By this, the end portions 28*c* and 29*c* of the respective projections 28*b* and 29*b* (serving as the restrainers 4A and 4B) do not abut upon the lower sides 66*a* of the hollow portions 66 (serving as the restrain portions 6E). Therefore, when, in this state, the cushioning material 30 is moved in the taking-out direction C, it is possible to easily remove the cushioning material 30 from the accommodation space S1.

Modification of Second Exemplary Embodiment

The restrain portion 6 of the cushioning-material side surface section of the cushioning material 30 is not limited to the lower side 66*a* of the exemplified hollow portion 66 according to the second exemplary embodiment (FIG. 30, etc.). The restrain portion 6 may have, for example, the structures shown in FIGS. 32 and 34, or the structures shown from FIGS. 35 to 37. These structures may also be similarly applied to the restrain portion 6 of the fourth cushioning-material side surface section 35 disposed opposite to the third cushioning-material side surface section 35.

Figure 32:
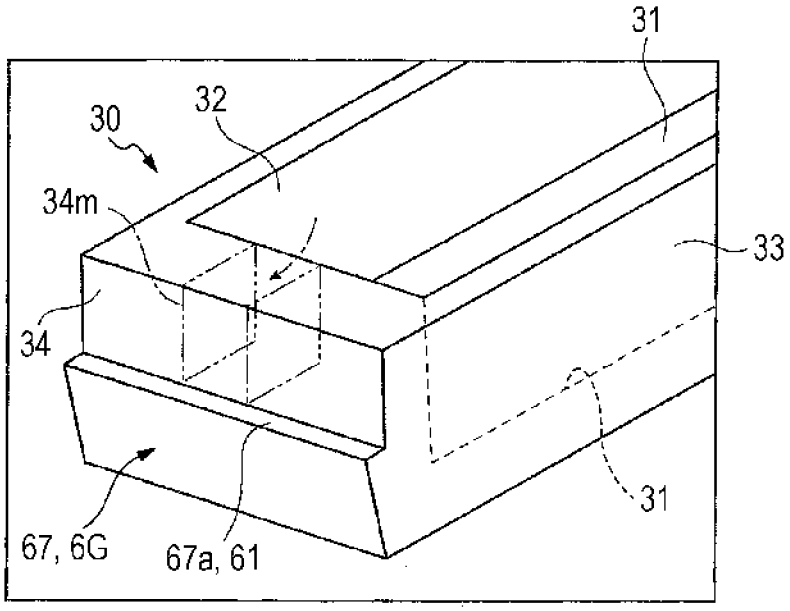
FIG. 32 is a perspective view of still another exemplary structure (principal portion) of the cushioning material.
Figure 33A:
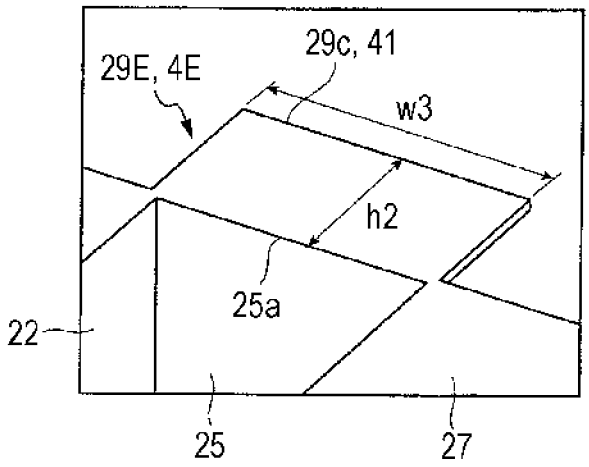
FIGS. 33A and 33B show another exemplary structure of a box body used in combination with the cushioning material shown in FIG. 32 (that is, the structure of a flap serving as a restrainer), with FIG. 33A being a perspective view of the structure of the flap serving as a restrainer in the box body, and FIG. 33B being a perspective view of a state in which the flap is bent.
Figure 33B:
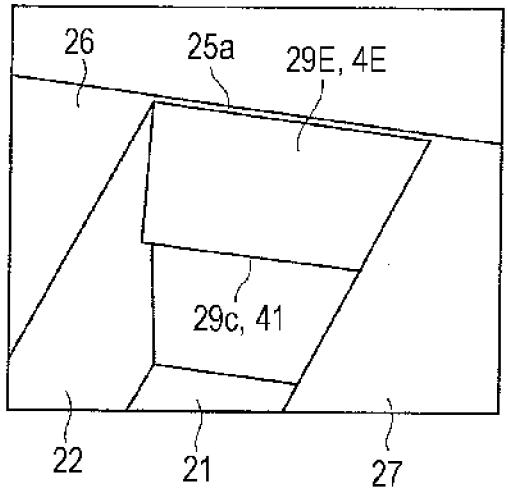
Figure 34:
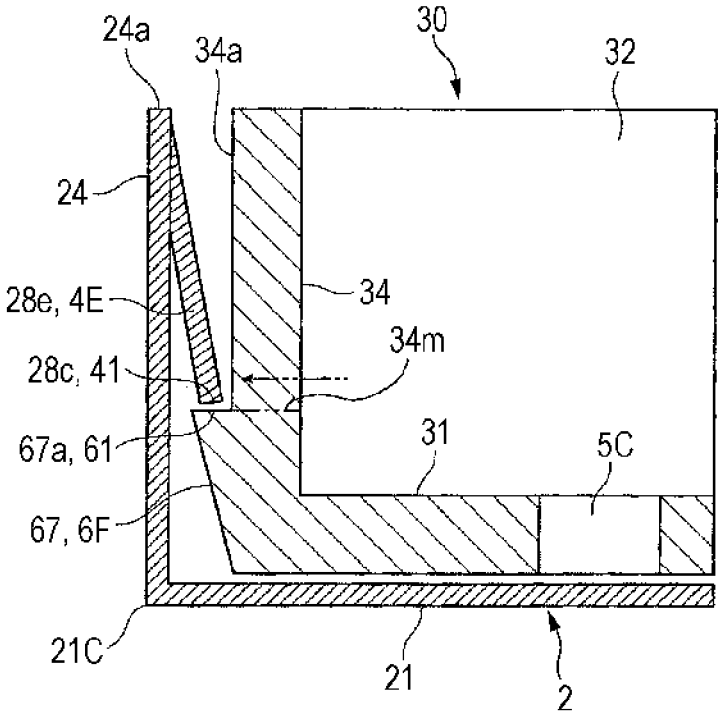
FIG. 34 is a sectional view illustrating a state in which a fitting operation is completed in the packaging box using the cushioning material shown in FIG. 32 and the box body shown in FIG. 33.

In a restrain portion 6G shown from FIGS. 32 to 34, a horizontal planar stepped portion 67 is formed at the lower portion of the outer surface 34*a* of the third cushioning-material side surface section 34, and a stepped surface 67*a* of the stepped portion 67 is used as a portion 61 of the restrain portion 6G. The stepped portion 67 projects outward over the entire width of the side surface section 34 from the outer surface 34*a*. Although the conditions regarding the position of formation of the stepped surface 67*a* of the stepped portion 67 may be the same as those regarding the position of formation of the lower side 66*a* of the hollow portion 66 according to the second exemplary embodiment, the conditions may differ. The stepped portion 67 may be formed by scraping an upper portion of the outer surface 34*a* of the third cushioning-material side surface section 34 and causing the upper portion to be hollow (recessed).

As a restrainer 4 of the flap of the box body 2 that forms a pair with the restrain portion 6G formed by the stepped portion 67, it is possible to use, for example, those shown in FIG. 33, etc. In the restrainer 4E exemplified in FIG. 33, a full-width flap 29*e* formed by cutting the flap 29 to an overall width w3 and a height h2 is formed, and an end portion 29*c* (serving as a free end of the flap 29*e*) is used as a portion 41 of the restrainer 4E. Although the height h2 of the flap 29*e* is the same as the height h2 of the projection 28*b* (serving as the restrainer 4), the heights h2 may differ from each other. The structure of the restrainer 4E is similarly applicable to the restrainer 4 of the third flap 28 disposed opposite to the fourth flap 29.

As shown in FIG. 34, when the cushioning material 30 is fitted into the accommodation space S1 of the box body 2, an end portion 28*c* of a full-width flap 28*e* where the restrainer 4E of the box body 2 is formed is moved above the stepped surface 67*a* of the stepped portion 67. Therefore, the restrain portion 6G formed by the stepped portion 67 is such that the stepped surface 67*a* of the stepped portion 67 opposes the end portion 28*c* so as to abut thereupon while the stepped surface 67*a* is positioned at the side of the bottom board 21. Accordingly, even if one tries to move the cushioning material 30 in the taking-out direction C, the stepped surface 67*a* of the stepped portion 67 (serving as the restrain portion 6G) abuts upon the flap 28*e* (serving as the restrainer 4E) and is prevented from moving. Therefore, the cushioning material 30 is retained in the accommodation space S1 without being removed. In addition, the restrain portion 6G formed by the stepped portion 67 is such that the range of displacement of the end portion 28*c* of the flap 28*e* is restricted by the outer surface 34*a* of the cushioning-material side surface section 34 existing above the stepped portion 67*a*. Therefore, for example, the end portion 28*c* is not displaced to positions that are situated away from the stepped surface 67*a* of the stepped portion 67. In addition, the state in which the end portion 28*c* and the stepped surface 67*a* oppose each other is stably maintained.

When one wants to take out the cushioning material 30 from the accommodation space S1, for example, the following operations are performed. That is, a thin member or a plate-like member is inserted in a gap between the flap 28*e* and the outer surface 34*a* of the third cushioning-material side surface section 34, and the flap 28*e* is displaced towards the side board 24 of the box body 2, so that the end portion 28*c* is displaced at a position where it does not abut upon the stepped surface 67*a* of the stepped portion 67. With the stepped surface 67*a* being displaced thus, the cushioning material 30 is moved upward in the taking-out direction C. As a structure for moving the end portion 28*c* of the flap 28*e* of the box body 2 away from the stepped surface 67*a* of the stepped portion 67 so that it longer abuts thereupon, the following structure may be used. That is, as shown by the alternate long and two short dash line in each of FIGS. 32 and 34, a penetration portion (a recess or a through hole) 34*m* is formed in, for example, a central portion of the third cushioning-material side surface section 34. With the penetration portion being formed, when the cushioning material 30 is to be removed, a finger or a member is inserted through the penetration portion 34*m* from the inside of the cushioning material 30, and the flap 28*e* is pushed away from the stepped surface 67*a* of the stepped portion as indicated by an alternate long and short dash line arrow. This structure may be similarly applied to the cushioning material 30 shown in, for example, FIG. 35.

Figure 35:
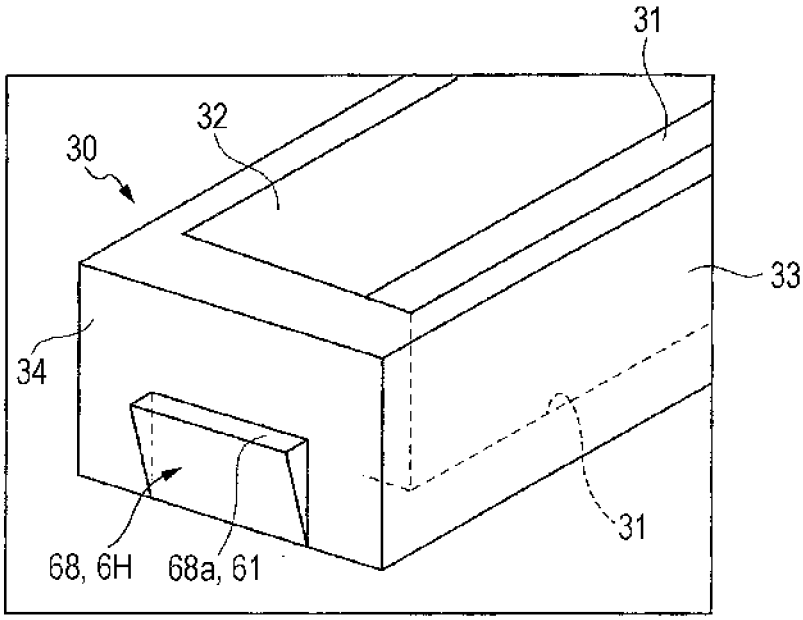
FIG. 35 is a perspective view of still another exemplary structure (principal portion) of the cushioning material.
Figure 36A:
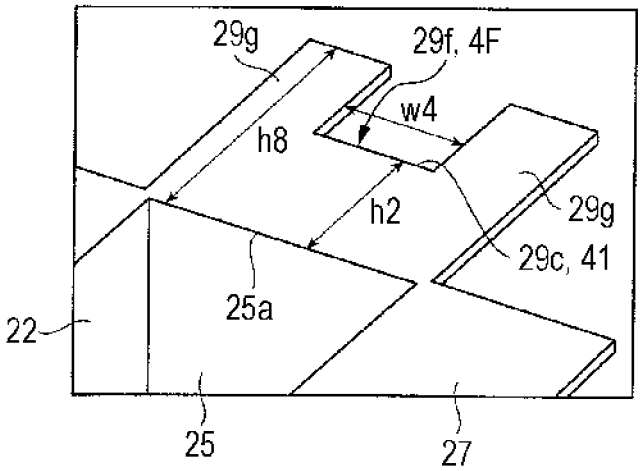
FIGS. 36A and 36B show another exemplary structure of the box body used in combination with the cushioning material shown in FIG. 35 (that is, the structure of a flap serving as a restrainer), with FIG. 36A being a perspective view of the structure of the flap serving as a restrainer in the box body, and FIG. 36B being a perspective view of a state in which the flap is bent.
Figure 36B:
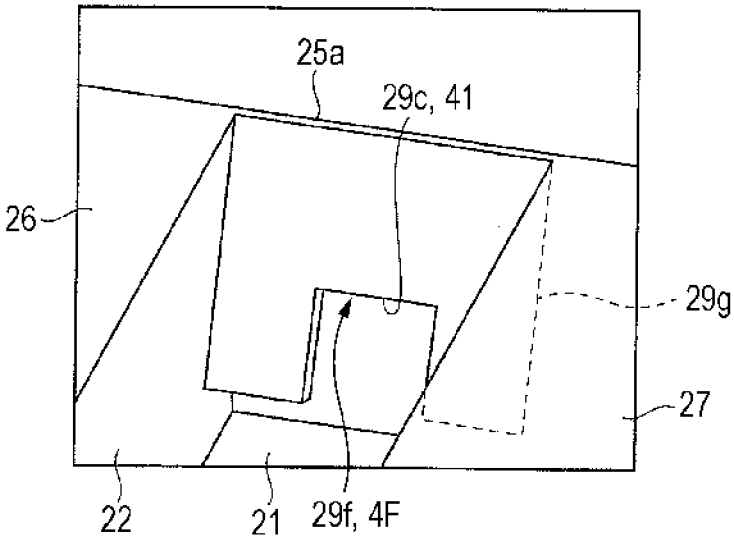
Figure 37:
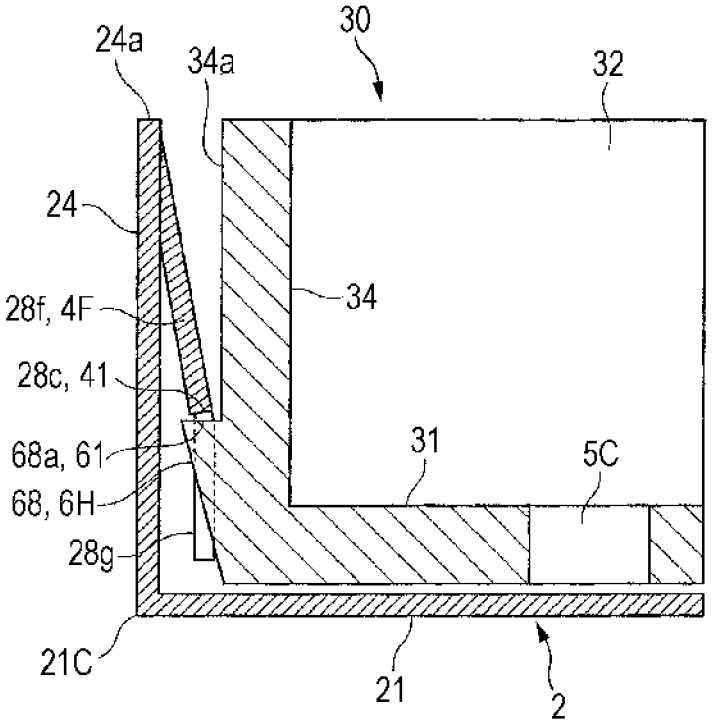
FIG. 37 is a sectional view illustrating a state in which a fitting operation is completed in the packaging box using the cushioning material shown in FIG. 35 and the box body shown in FIGS. 36A and 36B.

In the structure of a restrain portion 6H shown from FIGS. 35 to 37, a horizontal projection 68 is formed at a lower portion of the outer surface 34*a* of the third cushioning-material side surface section 34, and an upper stepped surface 68*a* of the projection 68 is used as a portion 61 of the restrain portion 6H. The conditions regarding the position of formation of the upper stepped surface 68*a* of the projection 68 may be the same as or different from those regarding the position of formation of the lower side 66*a* of the hollow portion 66 (or the position of formation of the stepped surface 67*a* of the stepped portion 67) in the second exemplary embodiment.

As the restrainer 4 of the flap of the box body 2 that forms a pair with the restrain portion 6H formed by the projection 68, for example, it is possible to use the restrain portion shown in, for example, FIGS. 36A and 36B. In the structure of a restrainer 4F, a recessed flap 29*f* is formed by cutting a recess in a central portion of the fourth flap 29 so as to have a width w4 (which is approximately ⅓ of the overall width w3 of the fourth flap 29) and a height h2 from an upper end 25*a* of the side board 25. In addition, an end portion 29*c*, serving as a free end of the recessed flap 29*f*, is used as a portion 41 of the restrainer 4E. Two projecting flap portions 29*g* and 29*g* are formed on the left and right sides of the recessed flap 29*f*. Each flap portion 29*g* has a height h8 that is higher than the height h2 of the recessed flap 29*f*. The height h2 of the recessed flap 29*f* may be the same as or different from the height h2 of the projection 28*b* serving as another restrainer 4. The structure of the restrainer 4F is similarly applicable to the restrainer 4 of the third flap 28 that is disposed opposite to the fourth flap 29.

As shown in FIG. 37, when the cushioning material 30 is fitted into the accommodation space S1 of the box body 2, an end portion 28*c* of a flap 28*f* that constitutes the restrainer 4F of the box body 2 is moved above the upper stepped surface 68*a* of the projection 68. Therefore, the restrain portion 6H formed by the projection 68 is such that the upper stepped surface 68*a* of the projection 68 opposes the end portion 28*c* so as to abut thereupon while the upper stepped surface 68*a* is positioned at the side of the bottom board 21. Accordingly, even if one tries to move the cushioning material 30 in the taking-out direction C, the upper stepped surface 68*a* of the projection 68 (serving as the restrain portion 6H) abuts upon the end portion 28*c* of the flap 28*f* (serving as the restrainer 4F) and is prevented from moving. Therefore, the cushioning material 30 is retained in the accommodation space S1 without being removed. In addition, the restrain portion 6H formed by the projection 68 is such the range of displacement of the end portion 28*c* of the flap 28*f* is restricted by the outer surface 34*a* of the cushioning-material side surface section 34 existing above the upper stepped surface 68*a*. Therefore, for example, the end portion 28*c* is not displaced to positions that are situated away from the upper stepped surface 68*a* of the projection 68. In addition, the state in which the end portion 28*c* and the upper stepped surface 68*a* oppose each other is stably maintained. On the other hand, when one wants to take out the cushioning material 30 from the accommodation space S1, operations that are the same as those when the restrainer 4E and the restrain portion 6G are formed may be performed.

Even in the packaging box according to the second exemplary embodiment, for example, covers that cover the air holes in the modification of the first exemplary embodiment may be similarly used. In this case, the covers are provided separately from the cushioning material 30.

Third Exemplary Embodiment

Figure 38:
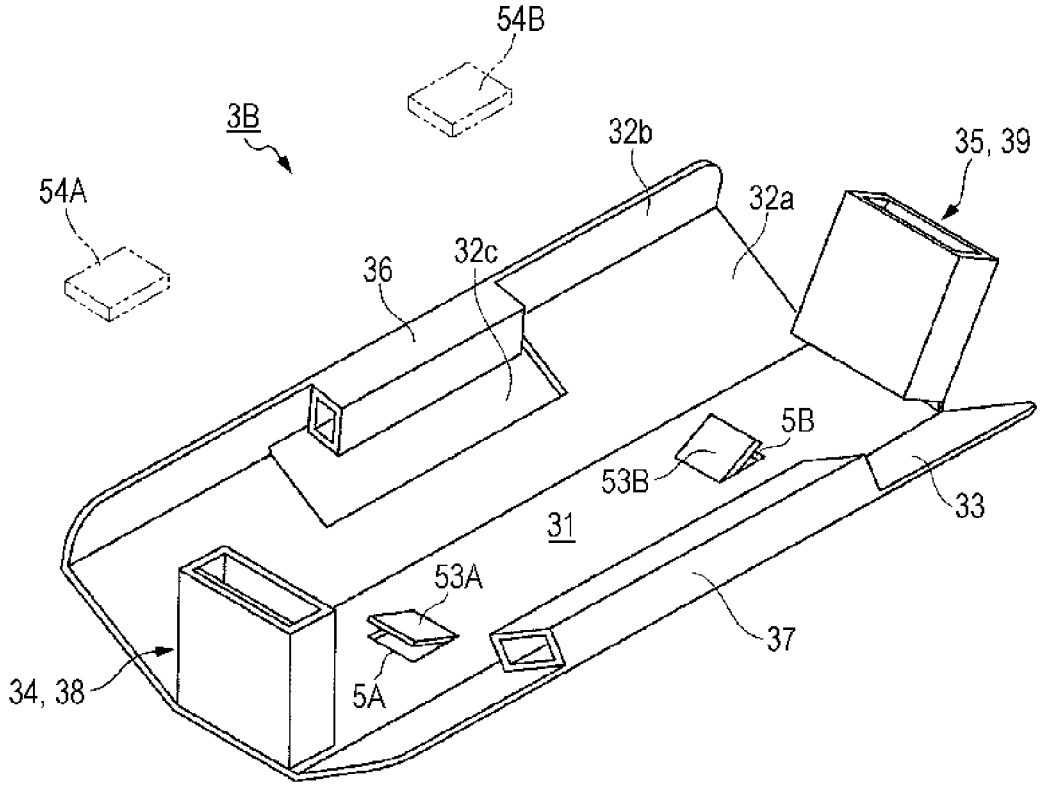
FIG. 38 is a perspective view of a cushioning material constituting a packaging box according to a third exemplary embodiment of the present invention.
Figure 39:
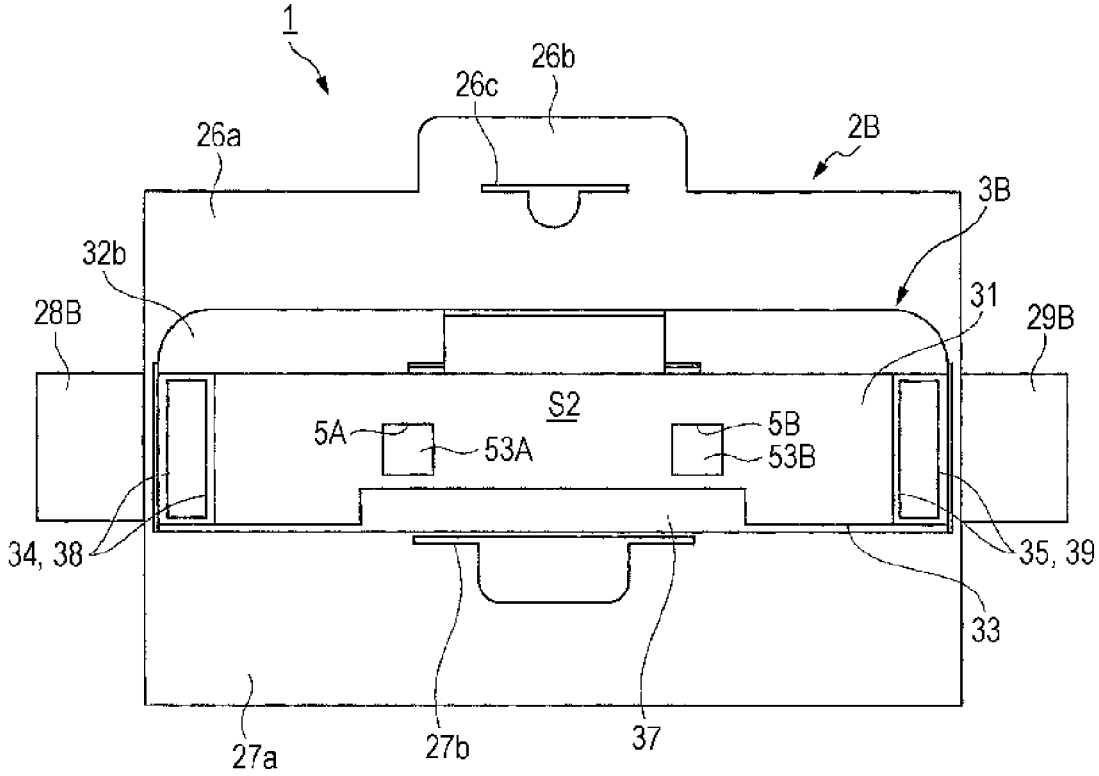
FIG. 39 is a plan view of a stage in which the cushioning material shown in FIG. 38 is fitted in an accommodation space of a box body used in combination therewith.

FIGS. 38 and 39 each show a packaging box 1 according to a third exemplary embodiment of the present invention. FIG. 38 shows a cushioning material 3B constituting the packaging box 1. FIG. 39 is a plan view showing a state in which the cushioning material 3B is fitted to an accommodation space S1 of a box body 2B constituting the packaging box 1.

The cushioning material 3B shown in FIG. 38 differs from the cushioning material 3 (see FIG. 9, etc.) in the first exemplary embodiment in that restrain portions 6 are not formed in a cushioning-material structural portion 38 of a third cushioning-material side surface section 34 and a cushioning-material structural portion 39 of a fourth cushioning-material side surface section 35 (as well as in the other cushioning-material side surface sections 32 and 33) and in that covers 53A and 53B that cover air holes 5A and 5B are formed in a bottom surface section 31.

The box body 2B used in combination with the cushioning material 3B differs from the box body 2 (see FIG. 7, etc.) according to the first exemplary embodiment in that restrainers 4 are not formed at a flap 28 of a third side board 24 and a flap 29 of a fourth side board 25 (as well as the other side boards 22 and 23), and the flaps 28 and 29 where the restrainers 4 are not formed are formed as ordinary inner covers of the box body 2B. The other structural features are the same.

Next, the states in the principal packaging steps using the packaging box 1 according to the third exemplary embodiment will be described.

First, as shown in FIG. 39, even in the packaging box 1, the cushioning material 3B is fitted to the accommodation space S1 of the box body 2B. More specifically, the cushioning material 3B is fitted as it is into the accommodation space S1 of the box body 2B whose four flaps 26 to 29 are set in a bent state in an opening direction. The covers 53A and 53B of the cushioning material 3B are set in a state in which they do not cover the air holes 5.

The shape of the bottom surface section 31 of the cushioning material 3B is the same as that of a bottom board 21 of the box body 2B, and its dimensions (long-side and short-side dimensions) are slightly smaller than those of the bottom board 21. Even in the cushioning material 3B, the air holes 5A and 5B are formed in the bottom surface section 31. Therefore, as with the fitting of the cushioning material 3 in the first exemplary embodiment, fitting of the cushioning material 3B into the accommodation space S1 of the box body 2B is easily performed without being subject to the resistance of air existing in a space E between the bottom surface section 31 of the cushioning material 3B and the bottom board 21 of the box body 2B. By this, the cushioning material 3B stops when it is fitted so that the bottom surface section 31 contacts the bottom board 21 of the box body 2B, thereby completing the fitting operation.

As shown in FIG. 39, by these steps, the packaging box 1 having the cushioning material 3B fitted to the accommodation space S1 of the box body 2B is obtained. As with the packaging box according to the previous exemplary embodiments, the packaging box 1 at this time has a new storage space S2 formed therein in addition to the accommodation space S1 of the box body 2. The storage space S2 is surrounded by four standing cushioning-material side surface sections 32 to 35 of the cushioning material 3B.

Then, a packaging object 100 is stored in the storage space S2 of the packaging box 1. When the packaging object 100 is to be stored, the covers 53A and 53B are set in a state in which they cover the air holes 5A and 5B by previously displacing the covers 53A and 53B with one's hands; or, by accommodation of the packaging object 100 that causes a portion of a bottom portion of the packaging object 100 to be displaced so as to contact and push down the covers 53A and 53B (see FIG. 28B). Accordingly, when the accommodation of the packaging object 100 ends, the air holes 5A and 5B are in a state in which they substantially do not pass air.

After the storage of the packaging object 100 using the packaging box 1 is completed, a bending portion 32*b* is inwardly bent, so that a cushioning-material structural portion 36 of the first cushioning-material side surface section 32 of the cushioning material 3B is placed in a gap between the packaging object 100 and the side board 22 of the box body 2B (actually, a side board portion 32*a* of the first cushioning-material side surface section 32 of the cushioning material 3B).

Then, the third and fourth flaps 28 and 29 (serving as inner covers of the box body 2B) are bent at an upper end 24*a* of the third side board 24 and an upper end 25*a* of the fourth side board 25, and are closed so that upper portions of respective ends of the packaging object in the longitudinal direction are covered. Thereafter, the fourth flap 27 (which is similarly an inner cover) is bent at an upper end 23*a* of the second side board 23, and is closed so as to cover the entire upper portion of the packaging object 100. Thereafter, the first flap 26 (serving as an outer cover of the box body 2B) is bent at an upper end 22*a* of the first side board 22, and is closed so as to be placed upon the second flap 27. Lastly, an insertion portion 26*b* of the first flap 26 of the box body 2B is inserted in an insertion cutaway portion 27*b* of the second flap 27. By this, the packing operation is completed.

As with the packaging box according to the first exemplary embodiment, the cushioning material 3B is interposed between all inside walls of the box body 2B and the packaging object 100 that is packaged in the packaging box 1. Therefore, if the packaging box 1 receives, for example, an external shock when it is transported, the shock is absorbed and cushioned by the cushioning material 3B. Consequently, the packaging object 100 is protected from such external shock.

On the other hand, it is possible to open the packaging box 1 by carrying out the above-described packaging steps in the reverse order.

Among these steps, when a person holds the packaging object 100 with his/her hands, lifts up the packaging object 100 from the accommodation space S1 of the packaging box 1 (actually, the storage space S2 formed by the cushioning material 3B), and takes out the packaging object 100 from the packaging box 1, only the packaging object 100 is capable of being taken out from the storage space S4 (formed by the cushioning material 3B) while the cushioning material 3B is retained in the accommodation space S1 of the box body 2.

This is thought to be due to the following reason. First, in the case where the cushioning material 3B is moved in the direction in which it is pulled out from the accommodation space S1 of the box body 2B when the packaging box 1 is being opened, the air holes 5A and 5B are covered by the covers 53A and 53B. Therefore, external air from the air holes 5A and 5B does not flow into the space E between the bottom surface section 31 of the cushioning material 3B and the bottom board 21 of the box body 2. Therefore, as in the foregoing description in which the cushioning material 3 is not easily pulled out when the air holes 5A and 5B are not formed in the cushioning material 3, the cushioning material 3B is not easily taken out from the accommodation space S1 because the taking out of the cushioning material 3B is subjected to the resistance of the air in the space E. Therefore, compared to the cushioning material in the structure in which the packaging box 1 is opened while the air holes 5A and 5B are uncovered, the possibility with which the cushioning material 3B is taken out from the accommodation space S1 of the box body 2B is reduced, so that it tends to be retained in the accommodation space S1.

Therefore, even when the packaging box 1 is being opened, it is possible to take out only the packaging object 100 from the accommodation space S2 (formed by the cushioning material 3B) while the cushioning material 3B is retained in the accommodation space S1 of the box body 2B. At this time, the cushioning material 3B is not damaged. In addition, after taking out the packaging object 100 (including after taking out the packaging object 100 when the packaging object 100 is packaged without contacting the cushioning material 3B), the cushioning material 3B is kept in a mounted state to the accommodation space S1 of the box body 2B, and is not dismounted.

Incidentally, when it is necessary to take out the cushioning material 3B in the packaging box 1 from the accommodation space S1 of the box body 2B, the cushioning material 3B is taken out from the accommodation space S1 after opening the covers 53A and 53B (provided at the bottom surface section 31 of the cushioning material 3B), and placing the air holes 5A and 5B in a state in which they are capable of passing air. This makes it possible to easily remove the cushioning material 3B from the accommodation space S1.

As illustrated in FIG. 38, as covers that cover the air holes 5A and 5B, the covers 54A and 54B that are provided separately from the cushioning material 3B may be provided and applied.

Other Exemplary Embodiments

Although, in each of the above-described exemplary embodiments, the box body 2 is exemplified as having the rectangular bottom board 21, the box body 2 may have a bottom board 21 having a polygonal shape, such as a triangular shape, a square shape, a quadrilateral shape, a pentagonal shape, and a hexagonal shape. In this case, the bottom surface section of the cushioning material 3 also has a shape which is substantially the same polygonal shape of the bottom board 21 of the box body 2.

In each of the above-described embodiments, the number of restrainers 4 and the number of restrain portions 6 are not limited to two. They may be one or three or more. For example, the number of restrainers 4 and the number of restrain portions 6 may be one less than the total number of sides of the polygonal shape of the bottom board 21 or the bottom surface section 31. In addition, for example, the shape and the number of the portions 41 of the restrainers 4 and the portions 61 of the restrain portions 6 are changeable.

In each of the above-described embodiments, for example, the number, the shape, and the position of formation of the air holes 5 in the bottom surface section of the cushioning material 3 are changeable as required.

Further, the material used to form the box body 2 and the cushioning material 3 of the packaging box 1 is not limited to a corrugated cardboard. Other materials (such as a plastic corrugated board, a plastic sheet, and styrofoam) may be used singly or in combination to form the packaging box 1.

The type of packaging object 100 that is accommodated in the packaging box 1 is not particularly limited. Therefore, for example, the shape and dimensions of the entire packaging box 1 (including the box body 2 and the cushioning material 3) are set in accordance with, for example, the dimensions and shape of the packaging object 100.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A packaging box comprising:

a box body having a bottom board, a plurality of side boards, and a plurality of bending flaps, the bottom board having a polygonal shape, the side boards standing from respective sides of the bottom board, the bending flaps bending at upper ends of the respective side boards, a space surrounded by the bottom board and the side boards being used as an accommodation space that accommodates a packaging object; and a cushioning material having a bottom surface section and a plurality of cushioning-material side surface sections, the bottom surface section having a polygonal shape which is substantially the same polygonal shape of the bottom board of the box body, the cushioning-material side surface sections standing from respective sides of the bottom surface section, the cushioning material being fitted in the accommodation space of the box body and existing between the box body and the packaging object accommodated in the accommodation space, wherein the bottom surface section of the cushioning material defines an air hole, wherein a restrainer is formed at at least one of the bending flaps of the box body, the restrainer having a portion that is separated from and opposes the bottom board of the box body when the portion of the restrainer is bent into the accommodation space of the box body, and wherein a restrain portion is formed at the cushioning-material side surface section of the cushioning material opposing the restrainer formed at the at least one of the bending flaps, the restrain portion having a portion that is positioned at a side of the bottom board of the box body so as to abut upon the portion of the restrainer and that opposes the portion of the restrainer when the cushioning material is fitted in the accommodation space of the box body.

2. The packaging box according to claim 1, wherein the restrainer includes an end portion of a bending portion of the bending flap, the bending portion being bent into the accommodation space of the box body, and wherein the restrain portion corresponds to a hollow structural portion or a projecting structural portion having the portion that opposes the end portion of the bending flap.

3. The packaging box according to claim 2, wherein the hollow restrain portion defines a through hole that extends through the cushioning-material side surface section of the cushioning material, a portion of an inner wall of the through hole being formed as the portion that opposes the end portion of the restrainer.

4. The packaging box according to claim 1, wherein the cushioning material has a structure that is used with the cushioning-material side surface sections being bent and standing at the respective sides of the bottom surface section, and wherein a tilting preventing portion is formed at the cushioning-material side surface section having the restrain portion, another cushioning-material side surface section adjacent to cushioning-material side surface section having the restrain portion, or the bottom surface section, the tilting preventing portion preventing the cushioning-material side surface section having the restrain portion from becoming tilted in a direction in which the cushioning-material side surface section having the restrain portion moves away from the restrainer.

5. The packaging box according to claim 1, further comprising a cover that covers the air hole.

6. The packaging box according to claim 5, wherein the cover is formed at the bottom surface section of the cushioning material, the cover being displaced so as to cover the air hole by being pushed by the packaging object that is being accommodated into the accommodation space of the box body.

7. The packaging box according to claim 1, wherein the cushioning material is formed by bending a corrugated cardboard.

8. A packaging box comprising:

a box body having a bottom board, a plurality of side boards, and a plurality of bending flaps, the bottom board having a polygonal shape, the side boards standing from respective sides of the bottom board, the bending flaps bending at upper ends of the respective side boards, a space surrounded by the bottom board and the side boards being used as an accommodation space that accommodates a packaging object; and a cushioning material having a bottom surface section and a plurality of cushioning-material side surface sections, the bottom surface section having a polygonal shape which is substantially the same polygonal shape of the bottom board of the box body, the cushioning-material side surface sections standing from respective sides of the bottom surface section, the cushioning material being fitted in the accommodation space of the box body and existing between the box body and the packaging object accommodated in the accommodation space, wherein the bottom surface section of the cushioning material defines an air hole, wherein the packaging box further comprises a cover that covers the air hole, and wherein the cover is formed at the bottom surface section of the cushioning material, the cover being displaced so as to cover the air hole by being pushed by the packaging object that is being accommodated into the accommodation space of the box body.

* * * * *